US009948069B2

(12) United States Patent
Segawa et al.

(10) Patent No.: US 9,948,069 B2
(45) Date of Patent: Apr. 17, 2018

(54) SPARK PLUG

(71) Applicant: NGK SPARK PLUG CO., LTD., Nagoya-shi, Aichi (JP)

(72) Inventors: Masayuki Segawa, Konan (JP); Daisuke Sumoyama, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/102,310

(22) PCT Filed: Dec. 16, 2014

(86) PCT No.: PCT/JP2014/083267
§ 371 (c)(1),
(2) Date: Jun. 7, 2016

(87) PCT Pub. No.: WO2015/093481
PCT Pub. Date: Jun. 25, 2015

(65) Prior Publication Data

US 2017/0033539 A1 Feb. 2, 2017

(30) Foreign Application Priority Data

Dec. 20, 2013 (JP) ..... 2013-264292

(51) Int. Cl.
*H01T 13/39* (2006.01)
*H01T 13/20* (2006.01)
*H01T 13/50* (2006.01)

(52) U.S. Cl.
CPC ..... *H01T 13/39* (2013.01); *H01T 13/20* (2013.01); *H01T 13/50* (2013.01)

(58) Field of Classification Search
CPC ..... H01T 13/39; H01T 13/20
(Continued)

(56) References Cited

U.S. PATENT DOCUMENTS 5,273,474 A * 12/1993 Oshima ..... H01T 21/02 219/121.64
5,310,373 A * 5/1994 Treiber ..... B21C 23/22 313/136

(Continued)

FOREIGN PATENT DOCUMENTS

DE 4431 143 A1 3/1996 ..... H01T 13/20
EP 0 989 646 A1 3/2000 ..... H01T 13/39

(Continued)

OTHER PUBLICATIONS

International Search Report issued in corresponding International Patent Application No. PCT/JP2014/083267, dated Feb. 10, 2015.

(Continued)

*Primary Examiner* — Christopher Raabe
(74) *Attorney, Agent, or Firm* — Kusner & Jaffe

(57) ABSTRACT

A spark plug wherein least one of a center electrode and a ground electrode includes a shaft portion and an electrode tip joined to one surface of the shaft portion. The shaft portion includes a first core formed of a material containing copper and a first outer layer that is formed of a material having higher corrosion resistance than the first core and covers at least part of the first core. The electrode tip includes a second outer layer that is formed of a material containing a noble metal and forms the outer surface of the electrode tip and a second core that is formed of a material having a higher thermal conductivity than the second outer layer and is at least partially covered with the second outer layer.

9 Claims, 5 Drawing Sheets

(58) Field of Classification Search
USPC ..... 313/141
See application file for complete search history.

(56) References Cited

U.S. PATENT DOCUMENTS

| | | | | | |
|---|---|---|---|---|---|
| 5,347,196 | A * | 9/1994 | Meershoek | H04N 3/185 | 315/278 |
| 5,440,198 | A * | 8/1995 | Oshima | H01T 21/02 | 313/141 |
| 5,456,624 | A * | 10/1995 | Moore | H01T 21/02 | 219/93 |
| 6,528,929 | B1 * | 3/2003 | Matsutani | H01T 13/39 | 313/141 |
| 8,841,828 | B2 * | 9/2014 | Igarashi | F02P 13/00 | 313/141 |
| 2013/0099654 | A1 * | 4/2013 | Ma | H01T 21/02 | 313/141 |
| 2013/0147338 | A1 * | 6/2013 | Stamper | H01T 13/39 | 313/141 |
| 2014/0175967 | A1 | 6/2014 | Igarashi et al. | 313/141 | |

FOREIGN PATENT DOCUMENTS

| | | | | |
|---|---|---|---|---|
| EP | 1005126 | A1 | 5/2000 | |
| JP | H05-013144 | A | 1/1993 | H01T 13/20 |
| JP | H05-036462 | A | 2/1993 | H01T 13/20 |
| JP | H05-054953 | A | 3/1993 | H01T 13/20 |
| JP | H10-106716 | A | 4/1998 | H01T 13/20 |
| JP | 2008-027870 | A | 2/2008 | C22C 38/00 |
| JP | 2012-089353 | A | 5/2012 | H01T 13/20 |
| JP | 2013-037806 | A | 2/2013 | F02P 13/00 |

OTHER PUBLICATIONS

Extended European Search Report issued in corresponding European Patent Application No. 14 87 2151 dated Jun. 21, 2017.
Office Action issued in corresponding European Patent Application No. 14872151.7 dated Jan. 29, 2018.

* cited by examiner

SPARK PLUG

RELATED APPLICATIONS

This application is a National Stage of International Application No. PCT/JP14/83267 filed Dec. 16, 2014, which claims the benefit of Japanese Patent Application No. 2013-264292, filed Dec. 20, 2013.

FIELD OF THE INVENTION

The present disclosure relates to a spark plug.

BACKGROUND OF THE INVENTION

Spark plugs have been used for internal combustion engines. These spark plugs have electrodes that form a gap. The electrodes used are, for example, electrodes having noble metal tips, in order to restrain consumption of the electrodes. One technique proposed to restrain an increase in the temperature of a center electrode is to join a noble metal tip to a shaft having a copper core embedded therein. With this technique, the increase in the temperature of the noble metal tip is restrained, and the consumption of the electrode can thereby be restrained.

However, long-term use may cause consumption of the noble metal tip. When the noble metal tip is consumed, discharge may not be generated appropriately. This problem is not specific to the center electrode but is common to the center electrode and a ground electrode.

The present disclosure discloses a technique for restraining consumption of an electrode.

SUMMARY OF THE INVENTION

The present disclosure discloses, for example, the following application examples.

APPLICATION EXAMPLE 1

In accordance with a first aspect of the present invention, there is provided a spark plug comprising a center electrode and a ground electrode that forms a gap with the center electrode, wherein at least one of the center electrode and the ground electrode includes a shaft portion and an electrode tip joined to one surface of the shaft portion, the shaft portion includes a first core formed of a material containing copper and a first outer layer that is formed of a material having higher corrosion resistance than the first core and covers at least part of the first core, and the electrode tip includes a second outer layer that is formed of a material containing a noble metal and forms an outer surface of the electrode tip and a second core that is formed of a material having a higher thermal conductivity than the second outer layer and is at least partially covered with the second outer layer.

According to this configuration, heat can be released from the second outer layer through the second core to the shaft portion, so that an increase in the temperature of the second outer layer can be restrained. Therefore, consumption of the second outer layer can be restrained.

APPLICATION EXAMPLE 2

In accordance with a second aspect of the present invention, there is provided a spark plug according to Application Example 1, wherein the second outer layer is formed of a material containing as a main component at least one of six noble metals including platinum, iridium, rhodium, ruthenium, palladium, and gold or a material containing as a main component an alloy of copper and any one of the six noble metals.

According to this configuration, the consumption of the second outer layer can be restrained appropriately.

APPLICATION EXAMPLE 3

In accordance with a third aspect of the present invention, there is provided a spark plug according to Application Example 2, wherein the second outer layer contains an oxide having a melting point of 1,840° C. or higher.

According to this configuration, the consumption of the second outer layer can be restrained appropriately.

APPLICATION EXAMPLE 4

In accordance with a fourth aspect of the present invention, there is provided a spark plug according to any one of Application Examples 1 to 3, wherein the first core and the second core are joined directly to each other.

According to this configuration, the increase in the temperature of the second outer layer can be appropriately restrained through the first core and the second core, so that the consumption of the second outer layer can be restrained.

APPLICATION EXAMPLE 5

In accordance with a fifth aspect of the present invention, there is provided a spark plug according to Application Example 4, wherein the first core and the second core are formed of an identical material.

According to this configuration, the first core and the second core can be easily joined to each other.

APPLICATION EXAMPLE 6

In accordance with a sixth aspect of the present invention, there is provided a spark plug according to any one of Application Examples 1 to 5, wherein the center electrode includes the shaft portion extending in an axial direction and the electrode tip joined to a forward end of the shaft portion, the electrode tip has a substantially cylindrical shape, and a thickness s is 0.03 mm or more and equal to or less than one-third of an outer diameter D, where the outer diameter D is an outer diameter of the electrode tip, and the thickness s is a radial thickness of a portion of the second outer layer that covers an outer circumferential surface of the second core.

According to this configuration, the consumption of the second outer layer can be restrained appropriately.

APPLICATION EXAMPLE 7

In accordance with a seventh aspect of the present invention, there is provided a spark plug according to Application Example 6, wherein an axial thickness t of a forward end portion of the second outer layer that covers a forward end portion of the second core is 0.1 mm or more and 0.4 mm or less.

According to this configuration, the consumption of the second outer layer can be restrained appropriately.

APPLICATION EXAMPLE 8

In accordance with an eighth aspect of the present invention, there is provided a spark plug according to Application Example 6 or 7, wherein the shaft portion and the electrode tip are joined to each other by a joining method including laser welding, and at least part of an axial range of a joint portion between the first core and the second core overlaps an axial range of a fused joint portion formed by fusing the first outer layer and the second outer layer.

According to this configuration, deterioration in the joint strength between the shaft portion and the electrode tip can be restrained.

The technique disclosed in the present description can be implemented in various forms. For example, the technique can be implemented in different forms such as a spark plug, an internal combustion engine including a spark plug, and a method of producing a spark plug.

DETAILED DESCRIPTION OF THE PREFERRED EMBODIMENTS

A. Embodiments

A-1. Configuration of Spark Plug

Figure 1:
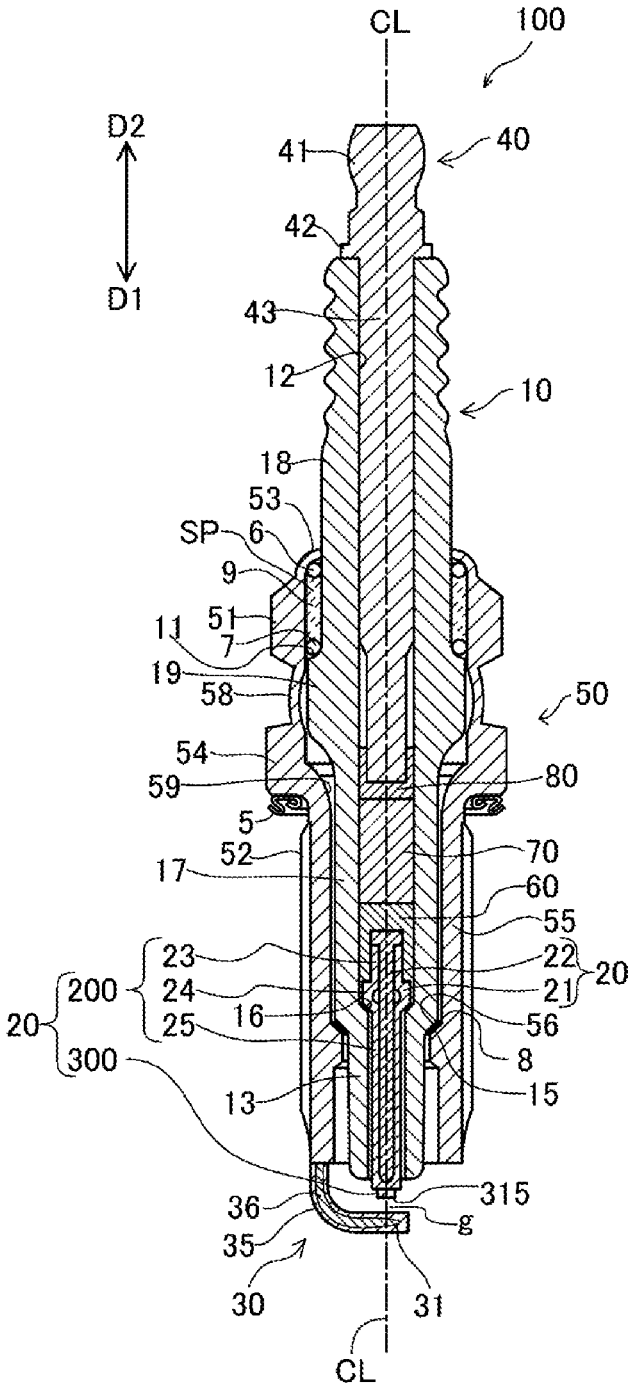
FIG. 1 is a cross-sectional view of an exemplary spark plug in an embodiment.

FIG. 1 is a cross-sectional view of an exemplary spark plug in an embodiment. A line CL shown in the figure represents the center axis of the spark plug 100. The illustrated cross section contains the center axis CL. In the following description, the center axis CL may be referred to also as an "axial line CL," and a direction parallel to the center axis CL may be referred to also as an "axial direction." A radial direction of a circle with its center on the center axis CL may be referred to simply as a "radial direction," and a circumferential direction of the circle with its center on the center axis CL may be referred to also as a "circumferential direction." Among directions parallel to the center axis CL, the downward direction in FIG. 1 will be referred to as a forward direction D1, and the upward direction will be referred to as a rearward direction D2. The forward direction D1 is a direction from a metallic terminal 40 described later toward electrodes 20 and 30 described later. The forward direction D1 side in FIG. 1 will be referred to as the forward end side of the spark plug 100, and the rearward direction D2 side in FIG. 1 will be referred to as the rear end side of the spark plug 100.

The spark plug 100 includes an insulator 10 (hereinafter referred to also as a "ceramic insulator 10"), the center electrode 20, the ground electrode 30, the metallic terminal 40, a metallic shell 50, an electrically conductive first seal portion 60, a resistor 70, an electrically conductive second seal portion 80, a forward-end-side packing 8, talc 9, a first rear-end-side packing 6, and a second rear-end-side packing 7.

The insulator 10 is a substantially cylindrical member having a through hole 12 (hereinafter referred to also as an "axial hole 12") extending along the center axis CL and penetrating the insulator 10. The insulator 10 is formed by firing alumina (other insulating materials may be used). The insulator 10 has a leg portion 13, a first outer-diameter decreasing portion 15, a forward-end-side trunk portion 17, a flange portion 19, a second outer-diameter decreasing portion 11, and a rear-end-side trunk portion 18, which are arranged in this order from the forward end side in the rearward direction D2. The outer diameter of the first outer-diameter decreasing portion 15 decreases gradually from the rear end side toward the forward end side. An inner-diameter decreasing portion 16 having an inner diameter decreasing gradually from the rear end side toward the forward end side is formed in the insulator 10 in the vicinity of the first outer-diameter decreasing portion 15 (in the forward-end-side trunk portion 17 in the example in FIG. 1). The outer diameter of the second outer-diameter decreasing portion 11 decreases gradually from the forward end side toward the rear end side.

The rod-shaped center electrode 20 extending along the center axis CL is inserted into a forward end portion of the axial hole 12 of the insulator 10. The center electrode 20 has a shaft portion 200 and an electrode tip 300 joined to the forward end of the shaft portion 200. The shaft portion 200 has a leg portion 25, a flange portion 24, and a head portion 23, which are arranged in this order from the forward end side in the rearward direction D2. The electrode tip 300 is joined to the forward end of the leg portion 25. The electrode tip 300 and a forward end portion of the leg portion 25 protrude outward from the axial hole 12 on the forward end side of the insulator 10. The other part of the shaft portion 200 is disposed within the axial hole 12. A surface of the flange portion 24 that is located on the forward direction D1 side is supported by the inner-diameter decreasing portion 16 of the insulator 10. The shaft portion 200 includes an outer layer 21 (referred to also as a "first outer layer 21") and a core 22 (referred to also as a "first core 22"). The rear end of the core 22 protrudes from the outer layer 21 and forms a rear end portion of the shaft portion 200. The other part of the core 22 is covered with the outer layer 21. The entire core 22 may be covered with the outer layer 21.

The outer layer 21 is formed of a material having higher corrosion resistance than the core 22, i.e., a material that is less likely to be consumed when exposed to combustion gas in a combustion chamber of an internal combustion engine. The material used for the outer layer 21 is, for example, nickel (Ni) or an alloy containing nickel as a main component (e.g., INCONEL ("INCONEL" is a registered trademark)). The main component is a component with the highest content (the same applies to the following). The content used is expressed in terms of percent by weight. The core 22 is formed of a material having a higher thermal conductivity than the outer layer 21, for example, a material containing copper (such as pure copper or an alloy containing copper).

The metallic terminal 40 is inserted into a rear end portion of the axial hole 12 of the insulator 10. The metallic terminal 40 is formed of an electrically conductive material (for example, a metal such as low-carbon steel). The metallic terminal 40 has a cap attachment portion 41, a flange portion 42, and a leg portion 43, which are arranged in this order from the rear end side in the forward direction D1. The cap attachment portion 41 protrudes outward from the axial hole 12 on the rear end side of the insulator 10. The leg portion 43 is inserted into the axial hole 12 of the insulator 10.

The resistor 70 having a circular columnar shape is disposed between the metallic terminal 40 and the center electrode 20 within the axial hole 12 of the insulator 10, in order to suppress electrical noise. The electrically conductive first seal portion 60 is disposed between the resistor 70 and the center electrode 20, and the electrically conductive second seal portion 80 is disposed between the resistor 70 and the metallic terminal 40. The center electrode 20 and the metallic terminal 40 are electrically connected to each other through the resistor 70 and the seal portions 60 and 80. The use of the seal portions 60 and 80 allows the contact resistance between the stacked members 20, 60, 70, 80, and 40 to be stabilized to thereby stabilize the electric resistance between the center electrode 20 and the metallic terminal 40. The resistor 70 is formed using glass particles (such as $B_2O_3$—$SiO_2$-based glass) serving as a main component, ceramic particles (such as $TiO_2$), and an electrically conductive material (such as Mg). The seal portions 60 and 80 are formed using, for example, the same glass particles as those for the resistor 70 and metal particles (such as Cu).

The metallic shell 50 is a substantially cylindrical member having a through hole 59 that extends along the center axis CL and penetrates the metallic shell 50. The metallic shell 50 is formed of low-carbon steel (other electrically conductive materials (e.g., metallic materials) may be used). The insulator 10 is inserted into the through hole 59 of the metallic shell 50. The metallic shell 50 is fixed to the outer circumference of the insulator 10. The forward end of the insulator 10 (a forward end portion of the leg portion 13 in the present embodiment) protrudes outward from the through hole 59 on the forward end side of the metallic shell 50. The rear end of the insulator 10 (a rear end portion of the rear-end-side trunk portion 18 in the present embodiment) protrudes outward from the through hole 59 on the rear end side of the metallic shell 50.

The metallic shell 50 has a trunk portion 55, a seat portion 54, a deformable portion 58, a tool engagement portion 51, and a crimp portion 53, which are arranged in this order from the forward end side toward the rear end side. The seat portion 54 is a flange-shaped portion. A threaded portion 52 to be screwed into an attachment hole of an internal combustion engine (e.g., a gasoline engine) is formed on the outer circumferential surface of the trunk portion 55. An annular gasket 5 formed by bending a metal plate is fitted between the seat portion 54 and the threaded portion 52.

The metallic shell 50 has an inner-diameter decreasing portion 56 disposed on the forward direction D1 side of the deformable portion 58. The inner diameter of the inner-diameter decreasing portion 56 decreases gradually from the rear end side toward the forward end side. The forward-end-side packing 8 is held between the inner-diameter decreasing portion 56 of the metallic shell 50 and the first outer-diameter decreasing portion 15 of the insulator 10. The forward-end-side packing 8 is an O-shaped ring formed of iron (other materials (e.g., metallic materials such as copper) may be used).

The tool engagement portion 51 has a shape (e.g., a hexagonal columnar shape) suitable for engagement with a spark plug wrench. The crimp portion 53 is disposed rearward of the tool engagement portion 51. The crimp portion 53 is disposed rearward of the second outer-diameter decreasing portion 11 of the insulator 10 and forms the rear end (namely, an end on the rearward direction D2 side) of the metallic shell 50. The crimp portion 53 is bent inward in the radial direction.

An annular space SP is formed between the inner circumferential surface of the metallic shell 50 and the outer circumferential surface of the insulator 10 on the rear end side of the metallic shell 50. In the present embodiment, the space SP is surrounded by the crimp portion 53 of the metallic shell 50, the tool engagement portion 51 of the metallic shell 50, the second outer-diameter decreasing portion 11 of the insulator 10, and the rear-end-side trunk portion 18 of the insulator 10. The first rear-end-side packing 6 is disposed within the space SP on its rear end side. The second rear-end-side packing 7 is disposed within the space SP on its forward end side. In the present embodiment, these rear-end-side packings 6 and 7 are iron-made C-shaped rings (other materials may be used). The gap between the two rear-end-side packings 6 and 7 within the space SP is filled with powder of talc 9.

When the spark plug 100 is produced, the crimp portion 53 is bent inward and crimped. The crimp portion 53 is thereby pressed toward the forward direction D1 side. In this manner, the deformable portion 58 is deformed, and the insulator 10 is pressed forward within the metallic shell 50 through the packings 6 and 7 and the talc 9. The forward-end-side packing 8 is pressed between the first outer-diameter decreasing portion 15 and the inner-diameter decreasing portion 56 to thereby establish a seal between the metallic shell 50 and the insulator 10. In this manner, leakage of gas in the combustion chamber of the internal combustion engine to the outside through the gap between the metallic shell 50 and the insulator 10 is suppressed. In addition, the metallic shell 50 is fixed to the insulator 10.

The ground electrode 30 is joined to the forward end of the metallic shell 50 (i.e., the end on the forward direction D1 side). In the present embodiment, the ground electrode 30 is a rod-shaped electrode. The ground electrode 30 extends from the metallic shell 50 in the forward direction D1, is bent toward the center axis CL, and forms a forward end portion 31. The forward end portion 31 and a forward end surface 315 of the center electrode 20 (a surface 315 on the forward direction D1 side) form a gap g therebetween. The ground electrode 30 is joined to the metallic shell 50 so as to be electrically continuous with the metallic shell 50 (by, for example, resistance welding). The ground electrode 30 includes a base member 35 that forms the surface of the ground electrode 30 and a core 36 embedded in the base member 35. The base member 35 is formed using, for example, INCONEL. The core 36 is formed using a material having a higher thermal conductivity than the base member 35 (e.g., pure copper).

A-2. Configuration of Forward End Portion of Center Electrode

Figure 2A:
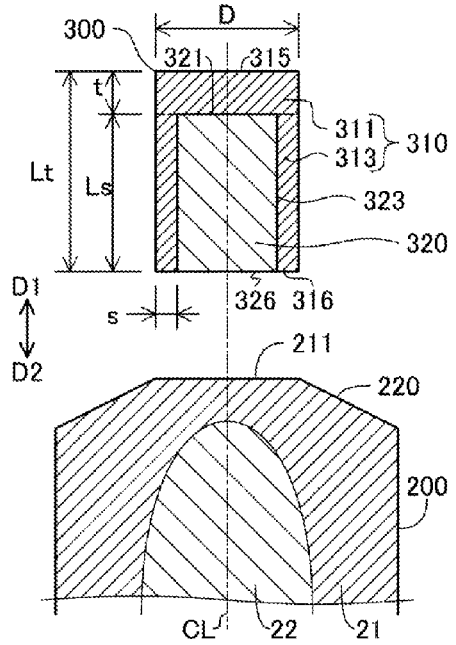
FIGS. 2(A) and 2(B) are cross-sectional views of a forward end portion of a center electrode 20.
Figure 2B:
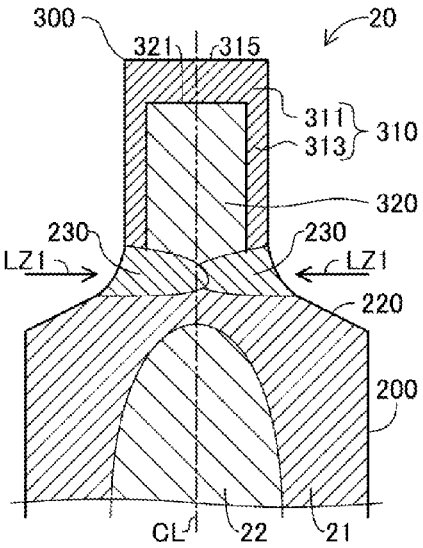

FIGS. 2(A) and 2(B) are a set of cross-sectional views of a forward end portion of the center electrode 20. FIG. 2(A) shows the shaft portion 200 and the electrode tip 300 before they are joined to each other. In the figure, the shaft portion 200 and the electrode tip 300 are arranged coaxially. FIG. 2(B) shows the shaft portion 200 and the electrode tip 300 joined to each other. Each of the cross sections contains the center axis CL.

First, the configuration of the electrode tip 300 before joining will be described. The electrode tip 300 has a substantially cylindrical shape with its center on the center axis CL. The electrode tip 300 has a second outer layer 310 that forms the outer surface of the electrode tip 300 and a core 320 (referred to also as a "second core 320") partially covered with the second outer layer 310. The second outer layer 310 is formed of a material containing a noble metal (such as iridium (Ir) or platinum (Pt)) (hereinafter referred to also as a "noble metal layer 310"). The core 320 is formed of a material (e.g., copper (Cu)) having a higher thermal conductivity than the noble metal layer 310.

The core 320 has a substantially cylindrical shape with its center on the center axis CL. The noble metal layer 310 has a tubular portion 313 having a substantially circular tubular shape with its center on the center axis CL and a forward end portion 311 that is a substantially disk-shaped portion with its center on the center axis CL. The tubular portion 313 covers an outer circumferential surface 323 of the core 320. The forward end portion 311 is connected to the forward end of the tubular portion 313 and covers a forward end surface 321 of the core 320. The forward end surface 315 of the forward end portion 311 (i.e., the forward end surface of the electrode tip 300) forms the gap g after the spark plug 100 (FIG. 1) is completed. Hereinafter, the surface 315 is referred to also as a "discharge surface 315." A rear end surface 326 of the core 320 is exposed externally from the noble metal layer 310. The rear end surface 326 of the core 320 and a rear end surface 316 of the noble metal layer 310 are arranged on substantially the same plane.

Any of various methods can be used to produce the electrode tip 300 configured as described above. For example, the following method can be used. The material of the noble metal layer 310 is molded into a cup shape having a recess, and the material of the core 320 is placed in the recess. Then the member, with the material of the core 320 placed in the recess, is stretched by rolling. Excess portions of the stretched member are cut, whereby the electrode tip 300 is formed.

Alternatively, the following method may be used. The material of the noble metal layer 310 is molded into a cylindrical shape, and the material of the core 320 is inserted into the cylindrical hole. The member, with the material of the core 320 inserted into the cylindrical hole, is stretched by rolling. Next, the stretched member is cut to obtain a cylindrical member having a prescribed length (this member corresponds to the tubular portion 313 and the core 320). Then a disk formed of the material of the noble metal layer 310 (the disk corresponds to the forward end portion 311) is joined to one end of the cylindrical member by laser welding, whereby the electrode tip 300 is formed.

Alternatively, the following method may be used. The material of the noble metal layer 310 is fired into a shape shown in FIG. 2(A), i.e., a container shape. Then the material of the core 320 is placed into the recess of the container shape and fired to form the electrode tip 300. The following method may also be used. A green compact having a container shape with a recess is formed using the material of the noble metal layer 310, and the material of the core 320 is placed into the recess of the compact. These materials are fired simultaneously to form the electrode tip 300.

Next, the configuration of the forward end portion of the shaft portion 200 before joining will be described. In the forward end portion of the shaft portion 200, the entire core 22 is covered with the outer layer 21. The shaft portion 200 has a diameter decreasing portion 220 that has an outer diameter decreasing in the forward direction D1. A forward end surface 211 is formed on the forward direction D1 side of the diameter decreasing portion 220. The rear end surfaces 316 and 326 of the electrode tip 300 are joined to the forward end surface 211.

The shaft portion 200 and the electrode tip 300 joined to each other are shown in FIG. 2(B). Arrows LZ1 in the figure schematically represent laser light used for joining (laser welding in this case). The entire circumference of the boundary (not shown) between the shaft portion 200 and the electrode tip 300 disposed on the forward end surface 211 of the shaft portion 200 is irradiated with the laser light LZ1. As a result of the irradiation with the laser light LZ1, a fused joint portion 230 that joins the shaft portion 200 to the electrode tip 300 is formed. The fused joint portion 230 is a portion fused during welding. In the embodiment in FIG. 2(B), the fused joint portion 230 is in contact with the outer layer 21 of the shaft portion 200, the noble metal layer 310 of the electrode tip 300, and the core 320 of the electrode tip 300. The fused joint portion 230 joins the outer layer 21 of the shaft portion 200 to the noble metal layer 310 and core 320 of the electrode tip 300.

Figure 3A:
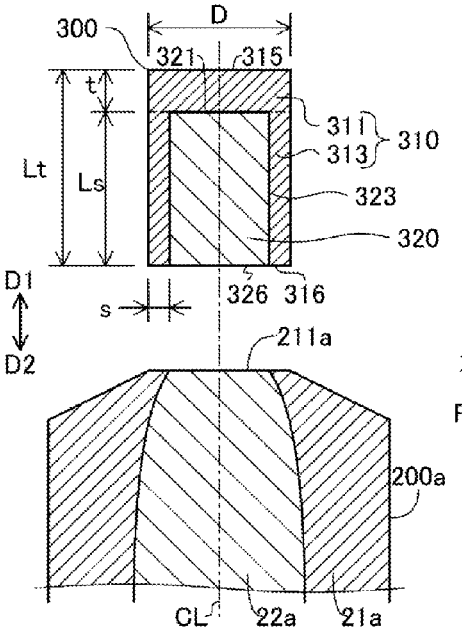
FIGS. 3(A) and 3(B) are cross-sectional views illustrating the configuration of another embodiment of the center electrode.
Figure 3B:
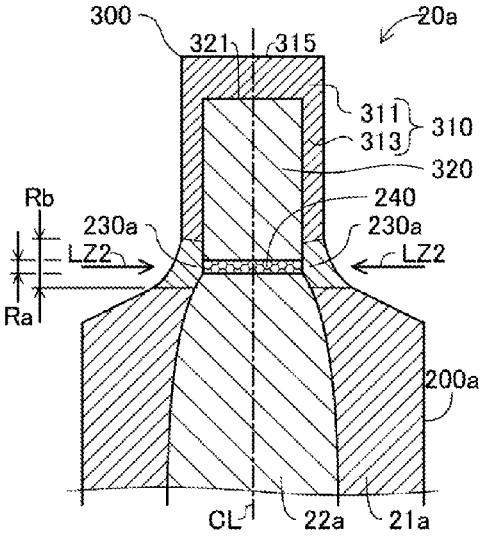

FIGS. 3(A) and 3(B) are a set of cross-sectional views illustrating the configuration of another embodiment of the center electrode. This center electrode is different from the center electrode 20 in FIGS. 2(A) and 2(B) in that the core 320 of the electrode tip 300 is joined directly to a core 22*a* (referred to also as a "first core 22*a*") of a center electrode 20*a*. The center electrode 20*a* in FIGS. 3(A) and 3(B) include a shaft portion 200*a* and the electrode tip 300. This electrode tip 300 is the same as the electrode tip 300 in FIGS. 2(A) and 2(B). The center electrode 20*a* in FIGS. 3(A) and 3(B) can be used instead of the center electrode 20 in FIGS. 2(A) and 2(B).

FIG. 3(A) shows the shaft portion 200*a* and the electrode tip 300 before joining, as does FIG. 2(A). FIG. 3(B) shows the shaft portion 200*a* and the electrode tip 300 joined to each other, as does FIG. 2(B). Each of these cross sections includes the center axis CL.

The exterior shape of the shaft portion 200*a* before joining is substantially the same as the exterior shape of the shaft portion 200 in FIGS. 2(A) and 2(B). The core 22*a* is exposed at a forward end surface 211*a* of the shaft portion 200*a*. On the forward end surface 211*a*, the core 22*a* is surrounded by an outer layer 21*a* (referred to also as a "first outer layer 21*a*"). When the rear end surfaces 316 and 326 of the electrode tip 300 are disposed on the forward end surface 211*a*, the noble metal layer 310 of the electrode tip 300 is in contact with the outer layer 21*a* of the shaft portion 200*a*, and the core 320 of the electrode tip 300 is in contact with the core 22*a* of the shaft portion 200*a*.

The shaft portion 200*a* and the electrode tip 300 joined to each other are shown in FIG. 3(B). Arrows LZ2 in the figure schematically represent laser light used for welding. The entire circumference of the boundary (not shown) between the shaft portion 200*a* and the electrode tip 300 disposed on the forward end surface 211*a* of the shaft portion 200*a* is irradiated with the laser light LZ2. As a result of the irradiation with the laser light LZ2, a fused joint portion 230*a* that joins the outer layer 21*a* of the shaft portion 200*a* to the noble metal layer 310 of the electrode tip 300 is formed.

In the embodiment in FIGS. 3(A), 3(B), diffusion bonding is performed in addition to the laser welding, in order to join the electrode tip 300 to the shaft portion 200*a*. Specifically, with a load applied in a direction toward the shaft portion 200*a* to the electrode tip 300, the electrode tip 300 and the shaft portion 200*a* are heated. The core 320 of the electrode tip 300 and the core 22*a* of the shaft portion 200*a* are thereby joined directly to each other. A joint portion 240 in the figure is formed by diffusion bonding and joins the two cores 320 and 22*a* to each other. The diffusion bonding may be performed after the laser welding. Alternatively, the laser welding may be performed after the diffusion bonding.

As described above, the joint portion 240 joins the core 22*a* of the shaft portion 200*a* to the core 320 of the electrode tip 300. The fused joint portion 230*a* is formed by fusion of the outer layer 21*a* of the shaft portion 200*a* and the noble metal layer 310 of the electrode tip 300. Next, attention is focused on positions in the axial direction. As shown in FIG. 3(B), a first range Ra, which is the range of the joint portion 240 in the axial direction, is contained in a second range Rb, which is the range of the fused joint portion 230*a* in the axial direction. In other words, the joint portion 240 is formed within the range in which the fused joint portion 230*a* is formed. The first range Ra of the joint portion 240 in the axial direction is the range from an end of the joint portion 240 on the forward direction D1 side to its end on the rearward direction D2 side. The second range Rb of the fused joint portion 230*a* in the axial direction is the range from an end of the fused joint portion 230*a* on the forward direction D1 side to its end on the rearward direction D2 side.

When the first range Ra is spaced apart from the second range Rb, the joint portion 240 may be formed at a position apart from the fused joint portion 230*a*. In this case, a gap (not shown), which is an unjoined portion between the electrode tip 300 and the shaft portion 200*a*, may be formed between the joint portion 240 and the fused joint portion 230*a* within the center electrode 20*a* after the electrode tip 300 is joined to the shaft portion 200*a*. When such a gap is formed within the center electrode 20*a*, the joint strength of the center electrode 20*a* can be lower than that when no gap is formed. When the first range Ra is contained in the second range Rb as in the embodiment in FIG. 3(B), the formation of a gap can be suppressed, so that deterioration in the joint strength between the electrode tip 300 and the shaft portion 200*a* can be suppressed. Part of the first range Ra may be located outside the second range Rb. It is generally preferable that the first range Ra at least partially overlaps the second range Rb. With such a configuration, the formation of a gap within the center electrode 20*a* can be suppressed, so that deterioration in the joint strength between the electrode tip 300 and the shaft portion 200*a* can be suppressed. The entire first range Ra may be located outside the second range Rb.

In the embodiment in FIGS. 3(A), 3(B), the outer circumferential edge of the joint portion 240 is in contact with the fused joint portion 230*a*. Although not illustrated, the entire outer circumferential edge of the joint portion 240 is in contact with the fused joint portion 230*a*. Therefore, the formation of such a gap described above within the center electrode 20*a* can be suppressed, and deterioration in the joint strength between the electrode tip 300 and the shaft portion 200*a* can be further suppressed. The edge of the joint portion 240 may be separated from the fused joint portion 230*a* in a certain circumferential portion. In any case, only laser welding may be used to form the joint portion 240 and the fused joint portion 230*a* without using diffusion bonding.

Figure 4A:
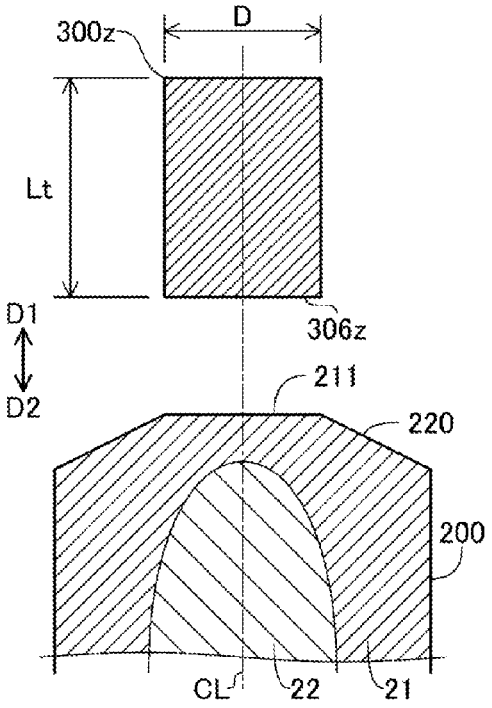
FIGS. 4(A) and 4(B) are cross-sectional views illustrating the configuration of a center electrode 20*z* in a reference example.
Figure 4B:
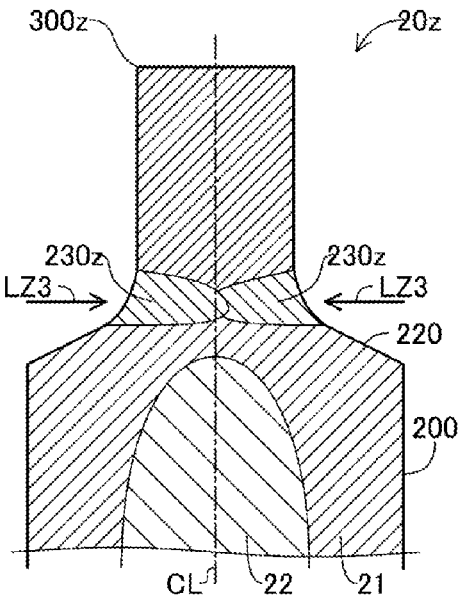

FIGS. 4(A), 4(B) are a set of cross-sectional views illustrating the configuration of a center electrode 20*z* in a reference example. This center electrode 20*z* is used as the reference example in evaluation tests described later. The center electrode 20*z* is different from the center electrode 20 in FIGS. 2(A), 2(B) only in that an electrode tip 300*z* with no core is used instead of the electrode tip 300. The center electrode 20*z* in FIGS. 4(A), 4(B) has a shaft portion 200 and an electrode tip 300*z*. This shaft portion 200 is the same as the shaft portion 200 in FIGS. 2(A), 2(B).

FIG. 4(A) shows the shaft portion 200 and the electrode tip 300*z* before joining, as does FIG. 2(A). FIG. 4(B) shows the shaft portion 200 and the electrode tip 300*z* joined to each other, as does FIG. 2(B). Each of these cross sections includes the center axis CL.

The exterior shape of the electrode tip 300*z* before joining is substantially the same as the exterior shape of the electrode tip 300 in FIGS. 2(A), 2(B). The electrode tip 300*z* is formed of the same material as the material of the noble metal layer 310 in FIGS. 2(A), 2(B). A rear end surface 306*z* of the electrode tip 300*z* is joined to the forward end surface 211 of the shaft portion 200.

The shaft portion 200 and the electrode tip 300*z* joined to each other are shown in FIG. 4(B). Arrows LZ3 in the figure schematically represent laser light used for welding. The entire circumference of the boundary (not shown) between the shaft portion 200 and the electrode tip 300*z* disposed on the forward end surface 211 of the shaft portion 200 is irradiated with the laser light LZ3. As a result of the irradiation with the laser light LZ3, a fused joint portion 230*z* that joins the shaft portion 200 to the electrode tip 300*z* is formed. The fused joint portion 230*z* joins the electrode tip 300*z* to the outer layer 21 of the shaft portion 200.

In FIGS. 2(A) to 4(B), symbols representing the dimensions of elements of the electrode tips 300 and 300*z* are shown. Outer diameters D represent the outer diameters of the electrode tips 300 and 300*z*. A first thickness s is the radial thickness of the tubular portion 313. A second thickness t is the thickness of the forward end portion 311 of the noble metal layer 310 in a direction parallel to the center axis CL. A total length Lt is the length of the electrode tip 300 in the direction parallel to the center axis CL. A tube length Ls is the length of the tubular portion 313 of the noble metal layer 310 in the direction parallel to the center axis CL. Preferably, these dimensions are determined such that consumption of the electrode tip 300 is restrained. For example, it is preferable that the first thickness s and the second thickness t are determined in consideration of relations described below.

Figure 5:
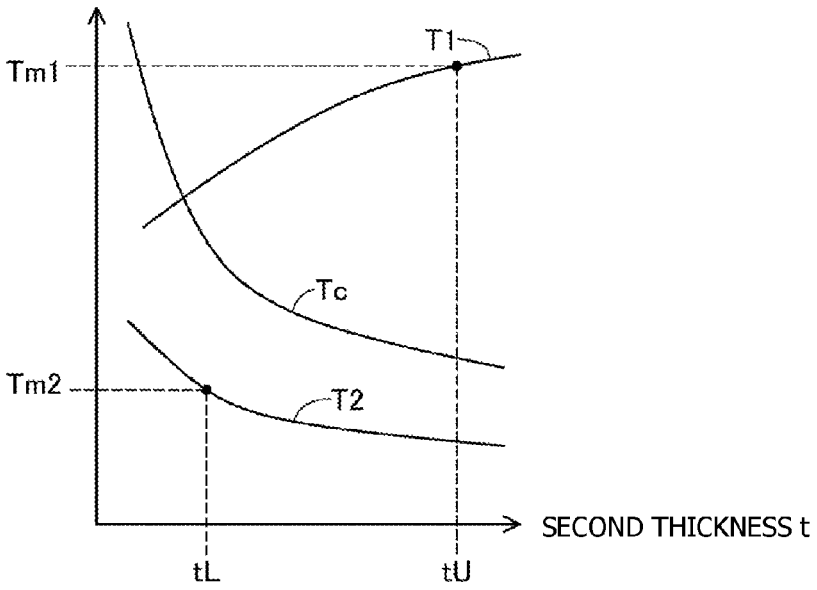
FIG. 5 is a graph schematically showing the relations of first temperature T1, second temperature T2, and thermal conductivity Tc to second thickness t.

FIG. 5 is a graph schematically showing the relations of first temperature T1, second temperature T2, and thermal conductivity Tc to the second thickness t. The horizontal axis represents the second thickness t, and the vertical axis represents the magnitude of each of the parameters T1, T2, and Tc. The first temperature T1 is the temperature of the discharge surface 315. The second temperature T2 is the temperature of the forward end surface 321 of the core 320. The thermal conductivity Tc is the thermal conductivity when heat is transferred from the electrode tip 300 to the shaft portion 200, 200*a*. When the total length Lt of the electrode tip 300 is fixed, the larger the second thickness t, the larger the noble metal layer 310, and the shorter the length Ls of the core 320. In this case, heat is not easily released from the electrode tip 300 to the shaft portion 200, 200*a*, i.e., the thermal conductivity Tc is low. Therefore, when the temperature of the electrode tip 300 increases due to electric discharge or combustion of fuel, the larger the second thickness t, the higher the first temperature T1. A first melting point Tm1 in the figure is the melting point of the noble metal layer 310. To suppress fusion of the noble metal layer 310, it is preferable that the second thickness t is small, and it is particularly preferable that the second thickness t is smaller than a thickness tU at which the first temperature T1 becomes equal to the first melting point Tm1.

The smaller the second thickness t, the closer the forward end surface 321 of the core 320 is to the discharge surface 315. Therefore, the smaller the second thickness t, the higher the second temperature T2 of the forward end surface 321 of the core 320. A second melting point Tm2 in the figure is the melting point of the core 320. To suppress fusion of the core 320, it is preferable that the second thickness t is large, and it is particularly preferable that the second thickness t is larger than a thickness tL at which the second temperature T2 becomes equal to the second melting point Tm2.

Figure 6:
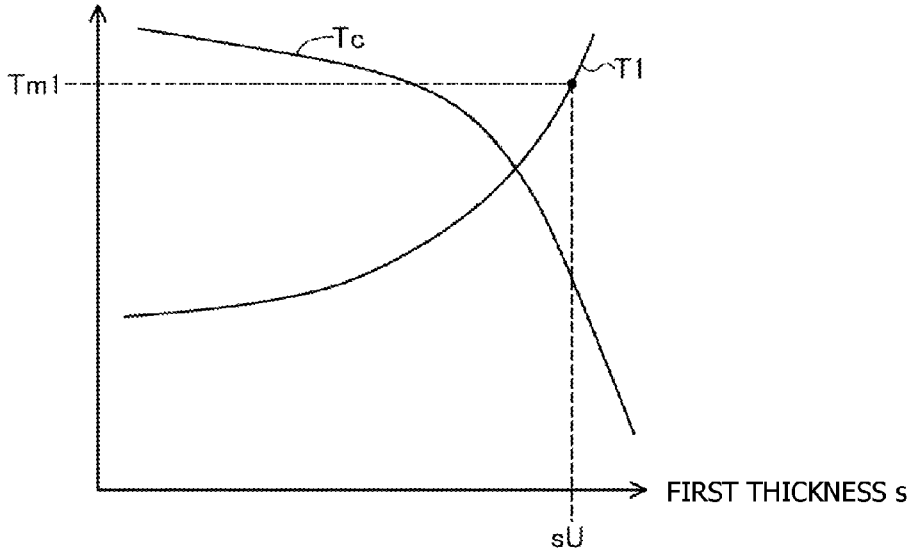
FIG. 6 is a graph schematically showing the relations of the first temperature T1 and the thermal conductivity Tc to first thickness s.

FIG. 6 is a graph schematically showing the relations of the first temperature T1 and the thermal conductivity Tc to the first thickness s. The horizontal axis represents the first thickness s, and the vertical axis represents the magnitude of each of the parameters T1 and Tc. When the outer diameter D of the electrode tip 300 is fixed, the larger the first thickness s, the smaller the outer diameter of the core 320. In this case, heat is not easily released from the electrode tip 300 to the shaft portion 200, 200*a*, i.e., the thermal conductivity Tc becomes low. Therefore, when the temperature of the electrode tip 300 increases due to electric discharge or combustion of fuel, the larger the first thickness s, the higher the first temperature T1. To suppress fusion of the noble metal layer 310, it is preferable that the first thickness s is small, and it is particularly preferable that the first thickness s is smaller than a thickness sU at which the first temperature T1 becomes equal to the first melting point Tm1.

B. Evaluation Tests

B-1. First Evaluation Test

In a first evaluation test using a spark plug sample, the amount of increase in the distance of the gap g after repeated electric discharges was evaluated. The distance of the gap g (FIG. 1) is the distance in the direction parallel to the center axis CL. The following Table 1 shows the configuration of each sample, the amount of increase in the distance of the gap g, and the results of evaluation.

TABLE 1

| | | WITH NO CORE (20z) | WITH CORE (20) | CONNECTED CORES (20a) |
|---|---|---|---|---|
| Cu CORE | GAP INCREASE (mm) | 0.12 | 0.02 | 0.01 |
| | EVALUATION | B | A | A |
| Ag CORE | GAP INCREASE (mm) | 0.12 | 0.02 | 0.02 |
| | EVALUATION | B | A | A |
| Au CORE | GAP INCREASE (mm) | 0.12 | 0.03 | 0.02 |
| | EVALUATION | B | A | A |

In the first evaluation test, seven samples with different combinations of three differently configured center electrodes (the center electrodes 20, 20*a*, and 20*z* in FIGS. 2(A) to 4(B)) with three materials (copper (Cu), silver (Ag), and gold (Au)) for the core 320 of the electrode tip 300 were evaluated. Table 1 above includes three separate tables corresponding to the three materials of the core 320. The data of the center electrode 20*z* in the reference example is common to these three tables.

In the seven samples used for the evaluation test, components of the spark plugs other than the center electrodes were common to these samples and were the same as those shown in FIG. 1. For example, the following components were common to the seven samples.

Material of base member 35 of ground electrode 30: INCONEL 600

Material of core 36 of ground electrode 30: Copper

Material of outer layer 21, 21*a* of shaft portion 200, 200*a*: INCONEL 600

Material of core 22, 22*a* of shaft portion 200, 200*a*: Copper

Outer diameter D of electrode tip 300, 300*z*: 0.6 mm

Total length Lt of electrode tip 300, 300*z*: 0.8 mm

Material of noble metal layer 310 and electrode tip 300*z*: Platinum

First thickness s of tubular portion 313 (only center electrodes 20 and 20*a*): 0.2 mm Thickness t of forward end portion 311 (only center electrodes 20 and 20*a*): 0.2 mm Initial value of distance of gap g: 1.05 mm The evaluation test was performed as follows. A spark plug sample was placed in air at 1 atmosphere, and electric discharge was repeated at 300 Hz for 100 hours. The electric discharge was generated by applying discharge voltage between the metallic terminal 40 and the metallic shell 50. The distance of the gap g was measured using pin gauges in steps of 0.01 mm before and after the repeated electric discharges. Then the difference between the measured distances was computed as the amount of increase. In Table 1, an A rating indicates that the amount of increase is 0.04 mm or less, and a B rating indicates that the amount of increase is more than 0.04 mm.

As shown in Table 1, the results of evaluation of the center electrodes 20 and 20*a* each having the core 320 (i.e., an A rating) are better than the results of evaluation of the center electrode 20*z* having no core 320 (i.e., a B rating). The reason for this is presumed to be that the core 320 of the electrode tip 300 allows heat generated by the electric discharges to be released from the electrode tip 300 to the shaft portion 200 or 200*a* to thereby restrain an increase in the temperature of the electrode tip 300. The results of evaluation of the center electrodes 20 and 20*a* each having the core 320 were good irrespective of the material of the core 320. The reason for this is presumed to be that the thermal conductivity of each of the three materials (copper, silver, and gold) of the core 320 is higher than the thermal conductivity of the noble metal layer 310 (platinum).

The amount of increase in the distance of the gap g tended to be smaller when the center electrode 20*a* in FIG. 3(B) was used than when the center electrode 20 in FIG. 2(B) was used. The reason for this is presumed to be as follows. The thermal conductivity of a portion containing the components of the outer layer 21 (nickel, iron, chromium, aluminum, etc.) (for example, the fused joint portion 230 in FIG. 2(B)) is lower than that of the cores 320 and 22. In the center electrode 20*a* in FIG. 3(B), the core 320 of the electrode tip 300 is joined directly to the core 22*a* of the shaft portion 200*a* without a portion containing the components of the outer layer 21 therebetween. Therefore, the core 320 allows heat to be appropriately released from the electrode tip 300 to the shaft portion 200*a*. It is therefore presumed that the use of the center electrode 20*a* in FIG. 3(B) allows the amount of increase in the distance of the gap g to be reduced.

In the case in which the center electrode 20*a* was used, the amount of increase in the distance of the gap g was smaller in the sample in which the material of the core 320 of the electrode tip 300 was copper which was the same as the material of the core 22*a* of the shaft portion 200*a* than in other samples. The reason for this is presumed to be that the use of the same material allows the two cores 320 and 22*a* to be appropriately joined and the increase in the temperature of the electrode tip 300 can thereby be restrained appropriately.

B-2. Second Evaluation Test

In a second evaluation test using a spark plug sample, the amount of increase in the distance of the gap g after operation of an internal combustion engine with the spark plug sample mounted thereto was evaluated. The following Table 2 shows the configuration of each sample, the amount of increase in the distance of the gap, and the results of evaluation.

TABLE 2

| | | WITH NO CORE (20z) | WITH CORE (20) | CONNECTED CORES (20a) |
|---|---|---|---|---|
| Cu CORE | GAP INCREASE (mm) | 0.43 | 0.1 | 0.05 |
| | EVALUATION | B | A | A |
| Ag CORE | GAP INCREASE (mm) | 0.43 | 0.16 | 0.1 |
| | EVALUATION | B | A | A |
| Au CORE | GAP INCREASE (mm) | 0.43 | 0.22 | 0.13 |
| | EVALUATION | B | A | A |

In the second evaluation test, seven samples having the same configurations as those of the seven samples evaluated in the first evaluation test were evaluated. Table 2 above includes three separate tables corresponding to the three materials of the core 320 of the electrode tip 300. The data of the center electrode 20*z* in the reference example is common to these three tables.

The evaluation test was performed as follows. The internal combustion engine used was an inline four cylinder engine with a displacement of 2,000 cc. The engine was operated at a rotation speed of 5,600 rpm for 20 hours. The distance of the gap g was measured using pin gauges before and after the operation. Then the difference between the measured distances was computed as the amount of increase. In Table 2, an A rating indicates that the amount of increase is 0.3 mm or less, and a B rating indicates that the amount of increase is more than 0.3 mm.

As shown in Table 2, the results of evaluation of the center electrodes 20 and 20*a* each having the core 320 (i.e., an A rating) are better than the results of evaluation of the center electrode 20*z* having no core 320 (i.e., a B rating). The reason for this is presumed to be that the core 320 of the electrode tip 300 allows heat generated by combustion to be released from the electrode tip 300 to the shaft portion 200 or 200*a* to thereby restrain an increase in the temperature of the electrode tip 300. The results of evaluation of the center electrodes 20 and 20*a* each having the core 320 were good irrespective of the material of the core 320. The reason for this is presumed to be that the thermal conductivity of each of the three materials (copper, silver, and gold) of the core 320 is higher than the thermal conductivity of the noble metal layer 310 (platinum).

The amount of increase in the distance of the gap g tended to be smaller when the center electrode 20*a* in FIG. 3(B) was used than when the center electrode 20 in FIG. 2(B) was used. The reason for this is presumed to be as follows. In the center electrode 20*a* in FIG. 3(B), the core 320 of the electrode tip 300 is joined directly to the core 22*a* of the shaft portion 200*a*. Therefore, the core 320 allows heat to be appropriately released from the electrode tip 300 to the shaft portion 200*a*.

In the case in which the center electrode 20*a* was used, the amount of increase in the distance of the gap g was smaller in the sample in which the material of the core 320 of the electrode tip 300 was copper which was the same as the material of the core 22 of the shaft portion 200*a* than in other samples. The reason for this is presumed to be that the use of the same material allows the two cores 320 and 22*a* to be appropriately joined and the increase in the temperature of the electrode tip 300 can thereby be restrained appropriately.

B-3. Third Evaluation Test

In a third evaluation test using a spark plug sample, the relation among the second thickness t, the amount of increase in the distance of the gap g after repeated electric discharges, and the concentration of platinum on the discharge surface 315 was evaluated. The following Table 3 shows the relation among the material of the core 320, the second thickness t, the amount of increase in the distance of the gap, the concentration of platinum (Pt) on the discharge surface 315, and the results of evaluation.

TABLE 3

| | | | | | | |
|---|---|---|---|---|---|---|
| Cu CORE | SECOND THICKNESS t (mm) | 0.05 | 0.1 | 0.2 | 0.4 | 0.6 |
| | GAP INCREASE (mm) | 0.00 | 0.01 | 0.02 | 0.03 | 0.05 |
| | Pt CONCENTRATION (at %) | 80 | 100 | 100 | 100 | 100 |
| | EVALUATION | B | A | A | A | B |
| Ag CORE | SECOND THICKNESS t (mm) | 0.05 | 0.1 | 0.2 | 0.4 | 0.6 |
| | GAP INCREASE (mm) | 0.00 | 0.01 | 0.02 | 0.04 | 0.06 |
| | Pt CONCENTRATION (at %) | 85 | 100 | 100 | 100 | 100 |
| | EVALUATION | B | A | A | A | B |
| Au CORE | SECOND THICKNESS t (mm) | 0.05 | 0.1 | 0.2 | 0.4 | 0.6 |
| | GAP INCREASE (mm) | 0.01 | 0.02 | 0.03 | 0.04 | 0.07 |
| | Pt CONCENTRATION (at %) | 85 | 100 | 100 | 100 | 100 |
| | EVALUATION | B | A | A | A | B |

In the third evaluation test, the center electrode used was the center electrode 20 in FIG. 2(B). Three materials (copper (Cu), silver (Ag), and gold (Au)) were evaluated as the material of the core 320 of the electrode tip 300. Table 3 above includes three separate tables corresponding to the three materials. Five values, 0.05, 0.1, 0.2, 0.4, and 0.6 (mm), were used as the second thickness t, and evaluation was performed for each of the materials using these values. In the third evaluation test, 15 samples described above were evaluated.

In each of the 15 samples, a noble metal tip (not shown) formed of platinum was provided in a portion of the ground electrode 30 (FIG. 1) that formed the gap g. In the 15 samples, components of the spark plugs other than the center electrodes were common to these samples and were the same as those shown in FIG. 1. The configurations of the center electrodes 20, i.e., the configurations of the spark plugs, were the same as the configurations of samples evaluated in the first evaluation test except that the center electrodes 20 had different second thicknesses t and the noble metal tips were added to the ground electrodes 30. For example, the following components were common to the 15 samples.

Material of base member 35 of ground electrode 30: INCONEL 600

Material of core 36 of ground electrode 30: Copper

Material of outer layer 21 of shaft portion 200: INCONEL 600

Material of core 22 of shaft portion 200: Copper

Outer diameter D of electrode tip 300: 0.6 mm

Total length Lt of electrode tip 300: 0.8 mm

Material of noble metal layer 310: Platinum

First thickness s of tubular portion 313: 0.2 mm

Initial value of distance of gap g: 1.05 mm

The details of the evaluation test are the same as those in the first evaluation test. Specifically, a spark plug sample was placed in air at 1 atmosphere, and electric discharge was repeated at 300 Hz for 100 hours. The amount of increase in the distance of the gap g is the difference (unit: mm) in the distance of the gap g before and after the repeated electric discharges. The concentration of platinum is the platinum concentration (unit: at %) on the discharge surface 315 after the repeated electric discharges. The concentration of platinum was measured using a WDS (Wavelength Dispersive X-ray Spectrometer) of an EPMA (Electron Probe Micro Analyzer). Ordinarily, the concentration of platinum on the discharge surface 315 is 100 at %. However, if the core 320 is fused, a component of the fused core 320 (copper in this case) moves to the discharge surface 315, and this may cause a reduction in the concentration of platinum on the discharge surface 315. In Table 3, an A rating indicates that the amount of increase in the distance of the gap g is 0.04 mm or less and the concentration of platinum is 90 at % or more. A B rating indicates that the amount of increase in the distance of the gap g is more than 0.04 mm or the concentration of platinum is less than 90 at %.

As shown in Table 3, the larger the second thickness t, the larger the amount of increase in the distance of the gap g. The reason for this is presumed to be that, as described in FIG. 5, as the second thickness t increases, the first temperature T1 of the discharge surface 315 becomes higher due to heat generated by electric discharges.

When the second thickness t was small, the concentration of platinum was low. The reason for this is presumed to be that, as described in FIG. 5, a small second thickness t results in fusion of the core 320.

An A rating was obtained when the second thickness t was 0.1, 0.2, and 0.4 (mm). Any of these values can be used as the lower limit of a preferred range (a range from the lower limit to the upper limit) of the second thickness t. Any of the above values that is equal to or larger than the lower limit can be used as the upper limit. For example, the preferred range of the second thickness t can be 0.1 mm or more and 0.4 mm or less.

B-4. Fourth Evaluation Test

In a fourth evaluation test using a spark plug sample, the relation between the first thickness s and the amount of increase in the distance of the gap g after repeated electric discharges was evaluated. Table 4 below shows the relation among the material of the core 320, the first thickness s, the amount of increase in the distance of the gap g, and the results of evaluation.

TABLE 4

| | | | | | | | |
|---|---|---|---|---|---|---|---|
| Cu CORE | FIRST THICKNESS s (mm) | 0.02 | 0.03 | 0.05 | 0.1 | 0.2 | 0.25 |
| | GAP INCREASE (mm) | 0.00 | 0.00 | 0.01 | 0.01 | 0.02 | 0.06 |
| | EVALUATION | A | A | A | A | A | B |
| Ag CORE | FIRST THICKNESS s (mm) | 0.02 | 0.03 | 0.05 | 0.1 | 0.2 | 0.25 |
| | GAP INCREASE (mm) | 0.00 | 0.00 | 0.01 | 0.01 | 0.02 | 0.05 |
| | EVALUATION | A | A | A | A | A | B |
| Au CORE | FIRST THICKNESS s (mm) | 0.02 | 0.03 | 0.05 | 0.1 | 0.2 | 0.25 |
| | GAP INCREASE (mm) | 0.00 | 0.00 | 0.01 | 0.02 | 0.03 | 0.07 |
| | EVALUATION | A | A | A | A | A | B |

In the fourth evaluation test, the center electrode used was the center electrode 20 in FIG. 2(B). Three materials (copper (Cu), silver (Ag), and gold (Au)) were evaluated as the material of the core 320 of the electrode tip 300. Table 4 above includes three separate tables corresponding to the three materials. Six values, 0.02, 0.03, 0.05, 0.1, 0.2, and 0.25 (mm), were used as the first thickness s, and evaluation was performed for each of the materials using these values. In the fourth evaluation test, 18 samples as described above were evaluated.

In each of the 18 samples, a noble metal tip (not shown) formed of platinum was provided in a portion of the ground electrode 30 (FIG. 1) that formed the gap g. In the 18 samples, components of the spark plugs other than the center electrodes were common to these samples and were the same as those shown in FIG. 1. The configurations of the center electrodes 20, i.e., the configurations of the spark plugs, were the same as the configurations of samples evaluated in the first evaluation test except that the center electrodes 20 had different first thicknesses s and the noble metal tips were added to the ground electrodes 30. For example, the following components were common to the 18 samples.

Material of base member 35 of ground electrode 30: INCONEL 600

Material of core 36 of ground electrode 30: Copper

Material of outer layer 21 of shaft portion 200: INCONEL 600

Material of core 22 of shaft portion 200: Copper

Outer diameter D of electrode tip 300: 0.6 mm

Total length Lt of electrode tip 300: 0.8 mm

Material of noble metal layer 310 and electrode tip 300*z*: Platinum

Thickness t of forward end portion 311: 0.2 mm

Initial value of distance of gap g: 1.05 mm

The details of the evaluation test are the same as those in the first evaluation test. Specifically, a spark plug sample was placed in air at 1 atmosphere, and electric discharge was repeated at 300 Hz for 100 hours. The amount of increase in the distance of the gap g is the difference (unit: mm) in the distance of the gap g before and after the repeated electric discharges. In Table 4, an A rating indicates that the amount increase in the distance of the gap g is 0.04 mm or less. A B rating indicates that the amount of increase in the distance of the gap g is more than 0.04 mm.

As shown in Table 4, the larger the first thickness s, the larger the amount of increase in the distance of the gap g. The reason for this is presumed to be that, as described in FIG. 6, as the first thickness s increases, the first temperature T1 of the discharge surface 315 becomes higher due to heat generated by electric discharges.

An A rating was obtained when the first thickness s was 0.02, 0.03, 0.05, 0.1, and 0.2 (mm). Any of these values can be used as the lower limit of a preferred range (a range from the lower limit to the upper limit) of the first thickness s. Any of the above values that is equal to or larger than the lower limit can be used as the upper limit. For example, a value equal to or larger than 0.02 mm can be used as the first thickness s. A value equal to or less than 0.2 mm can be used as the first thickness s.

The temperature of the noble metal layer 310 is more likely to increase as the size of the core 320 relative to the size of the noble metal layer 310 decreases. For example, the temperature of the noble metal layer 310 is more likely to increase as the ratio of the first thickness s to the outer diameter D of the electrode tip 300 increases. Therefore, a preferred range of the first thickness s obtained in the fourth evaluation test can be defined using the ratio of the first thickness s to the outer diameter D. For example, in the fourth evaluation test, the outer diameter D is 0.6 mm. Therefore, an A rating was obtained when the ratio of the first thicknesses s to the outer diameter D was 1/30, 1/20, 1/12, 1/6, and 1/3. Any of these values can be used as the lower limit of the preferred range (a range from the lower limit to the upper limit) of the first thickness s. Any of the above values that is equal to or larger than the lower limit can be used as the upper limit. For example, a value equal to or larger than 1/30 of the outer diameter D can be used as the first thickness s. A value equal to or less than 1/3 of the outer diameter D can be used as the first thickness s.

B-5. Fifth Evaluation Test

In a fifth evaluation test using a spark plug sample, the relation among the outer diameter D, the first thickness s, and the amount of increase in the distance of the gap g after repeated electric discharges was evaluated. The following Table 5 shows the relation among the material of the core 320, the outer diameter D, the first thickness s, the amount of increase in the distance of the gap g, the threshold value of the amount of increase, and the results of evaluation.

TABLE 5

| | | | | | | | | | | | |
|---|---|---|---|---|---|---|---|---|---|---|---|
| Cu CORE | OUTER DIAMETER D (mm) | 0.3 | | 0.6 | | 0.9 | | 1.8 (200 h) | | 3.6 (800 h) | |
| | FIRST THICKNESS s (mm) | 0.10 | 0.12 | 0.2 | 0.25 | 0.3 | 0.38 | 0.6 | 0.8 | 1.2 | 1.6 |
| | GAP INCREASE (mm) | 0.08 | 0.26 | 0.02 | 0.06 | 0.01 | 0.03 | 0.01 | 0.03 | 0.005 | 0.03 |
| | THRESHOLD VALUE (mm) | 0.10 | | 0.04 | | 0.02 | | 0.02 | | 0.02 | |
| | EVALUATION | A | B | A | B | A | B | A | B | A | B |
| Ag CORE | OUTER DIAMETER D (mm) | 0.3 | | 0.6 | | 0.9 | | 1.8 (200 h) | | 3.6 (800 h) | |
| | FIRST THICKNESS s (mm) | 0.10 | 0.12 | 0.2 | 0.25 | 0.3 | 0.38 | 0.6 | 0.8 | 1.2 | 1.6 |
| | GAP INCREASE (mm) | 0.07 | 0.22 | 0.02 | 0.05 | 0.01 | 0.03 | 0.01 | 0.03 | 0.005 | 0.03 |
| | THRESHOLD VALUE (mm) | 0.10 | | 0.04 | | 0.02 | | 0.02 | | 0.02 | |
| | EVALUATION | A | B | A | B | A | B | A | B | A | B |
| Au CORE | OUTER DIAMETER D (mm) | 0.3 | | 0.6 | | 0.9 | | 1.8 (200 h) | | 3.6 (800 h) | |
| | FIRST THICKNESS s (mm) | 0.10 | 0.12 | 0.2 | 0.25 | 0.3 | 0.38 | 0.6 | 0.85 | 1.2 | 1.7 |
| | GAP INCREASE (mm) | 0.10 | 0.30 | 0.03 | 0.07 | 0.02 | 0.05 | 0.01 | 0.03 | 0.005 | 0.03 |
| | THRESHOLD VALUE (mm) | 0.10 | | 0.04 | | 0.02 | | 0.02 | | 0.02 | |
| | EVALUATION | A | B | A | B | A | B | A | B | A | B |

In the fifth evaluation test, the center electrode used was the center electrode 20 in FIG. 2(B). Three materials (copper (Cu), silver (Ag), and gold (Au)) were evaluated as the material of the core 320 of the electrode tip 300. Table 5 above includes three separate tables corresponding to the three materials. Five values, 0.3, 0.6, 0.9, 1.8, and 3.6 (mm), were used as the outer diameter D, and evaluation was performed for each of the materials using these values. For each of the values of the outer diameter D, two values, i.e., one-third of the outer diameter D and a value larger than this value, were used as the first thickness s and evaluated. The threshold value is the basis for evaluation of the amount of increase in the distance of the gap g. The threshold value is determined in advance according to the outer diameter D (the threshold value tends to increase as the outer diameter D increases). As described above, in the fifth evaluation test, 30 samples were evaluated.

In each of the 30 samples, a noble metal tip (not shown) formed of platinum was provided in a portion of the ground electrode 30 (FIG. 1) that formed the gap g. In the 30 samples, components of the spark plugs other than the center electrodes were common to these samples and were the same as those shown in FIG. 1. The configurations of the center electrodes 20, i.e., the configurations of the spark plugs, were the same as the configurations of samples evaluated in the first evaluation test except that the center electrodes 20 had different outer diameters D and different first thicknesses s and the noble metal tips were added to the ground electrodes 30. For example, the following components were common to the 30 samples.

Material of base member 35 of ground electrode 30: INCONEL 600

Material of core 36 of ground electrode 30: Copper

Material of outer layer 21 of shaft portion 200: INCONEL 600

Material of core 22 of shaft portion 200: Copper

Total length Lt of electrode tip 300: 0.8 mm

Material of noble metal layer 310: Platinum

Thickness t of forward end portion 311: 0.2 mm

Initial value of distance of gap g: 1.05 mm

The details of the evaluation test are the same as those in the first evaluation test. Specifically, a spark plug sample was placed in air at 1 atmosphere, and electric discharge was repeated at 300 Hz. The repetition time of the electric discharge was 100 hours when the outer diameter D was 0.3, 0.6, and 0.9 mm, 200 hours when the outer diameter D was 1.8 mm, and 800 hours when the outer diameter D was 3.6 mm. The amount of increase in the distance of the gap g is the difference (unit: mm) in the distance of the gap g before and after the repeated electric discharges. An A rating indicates that the amount of increase in the distance of the gap g is equal to or less than the threshold value. A B rating indicates that the amount of increase in the distance of the gap g is larger than the threshold value.

As shown in Table 5, the larger the outer diameter D, the smaller the amount of increase in the distance of the gap g. The reason for this is presumed to be that, since the volume of the noble metal layer 310 increases as the outer diameter D increases, the increase in the temperature of the noble metal layer 310 is restrained.

In samples with the same outer diameter D, the larger the first thickness s, the larger the amount of increase in the distance of the gap g. The reason for this is presumed to be that, as described in FIG. 6, as the first thickness s increases, the first temperature T1 of the discharge surface 315 becomes higher due to heat generated by electric discharges.

As shown in Table 5, in samples with outer diameters D equal to or larger than 0.6 mm, the results of evaluation were good when the first thickness s was one-third of the outer diameter D. Specifically, the amount of increase in the distance of the gap g was 0.04 mm or less. When the outer diameter D was 0.3 mm, the amount of increase in the distance of the gap g exceeded 0.04 mm. However, when the first thickness s was one-third of the outer diameter D, the amount of increases could be suppressed to 0.10 mm or less. As described above, the preferred range of the first thickness s discussed in the fourth evaluation test can be applied to various outer diameters D.

The results of evaluation were improved by reducing the first thickness s to one-third of the outer diameter D when the outer diameter D was 0.3, 0.6, 0.9, 1.8, and 3.6 (mm). Therefore, any of these values can be used as the lower limit of a preferred range (a range from the lower limit to the upper limit) of the outer diameter D. Any of the above values that is equal to or larger than the lower limit can be used as the upper limit. For example, a value equal to or larger than 0.3 mm can be used as the outer diameter D. A value equal to or less than 3.6 mm can be used as the outer diameter D.

B-6. Sixth Evaluation Test

In a sixth evaluation test, samples of the electrode tip 300 were used to evaluate the relation between the thickness s and the presence or absence of a crack caused by thermal cycles in each electrode tip 300. The following Table 6 shows the relation among the material of the core 320, the first thickness s, the presence or absence of a crack, and the results of evaluation.

TABLE 6

| | | | | | | |
|---|---|---|---|---|---|---|
| Cu CORE | FIRST THICKNESS s (mm) | 0.02 | 0.03 | 0.05 | 0.1 | 0.2 |
| | CRACK | YES | NO | NO | NO | NO |
| | EVALUATION | B | A | A | A | A |
| Ag CORE | FIRST THICKNESS s (mm) | 0.02 | 0.03 | 0.05 | 0.1 | 0.2 |
| | CRACK | YES | NO | NO | NO | NO |
| | EVALUATION | B | A | A | A | A |
| Au CORE | FIRST THICKNESS s (mm) | 0.02 | 0.03 | 0.05 | 0.1 | 0.2 |
| | CRACK | YES | NO | NO | NO | NO |
| | EVALUATION | B | A | A | A | A |

Three materials (copper (Cu), silver (Ag), and gold (Au)) were evaluated as the material of the core 320 of the electrode tip 300. Table 6 above includes three separate tables corresponding to the three materials. Five values, 0.02, 0.03, 0.05, 0.1, and 0.2 (mm), were used as the first thickness s, and evaluation was performed for each of the materials using these values. As described above, in the sixth evaluation test, 15 samples were evaluated. The following components were common to the 15 samples.

Outer diameter D of electrode tip 300, 300*z*: 0.6 mm

Total length Lt of electrode tip 300, 300*z*: 0.8 mm

Material of noble metal layer 310: Platinum

Thickness t of forward end portion 311: 0.2 mm

In the sixth evaluation test, a plate of INCONEL 600 was welded to the rear end surfaces 316 and 326 of each sample of the electrode tip 300 (FIGS. 2(A), 2(B)), as was the shaft portion 200. The sample was placed in a chamber filled with nitrogen, and a cycle including heating the sample and cooling the sample by relaxing the heating was repeated. In one cycle, the heating treatment was performed for one minute, and the cooling treatment was performed for one minute. In the heating treatment, the temperature of the electrode tip 300 increased to 1,100° C. In the cooling treatment, the temperature of the electrode tip 300 was reduced to 200° C. The above heating-cooling cycle was repeated 1,000 times. After 1,000 repetitions, the electrode tip 300 was observed to determine whether or not a crack occurred in the electrode tip 300. For example, expansion of the core 320 during heating can cause a crack in the noble metal layer 310. In Table 6, an A rating indicates that no crack occurred, and a B rating indicates that a crack occurred.

As shown in Table 6, a crack occurred when the first thickness s was small. The reason for this is presumed to be that, when the first thickness s is small, the noble metal layer 310 cannot withstand the expansion of the core 320.

An A rating was obtained when the first thickness s was 0.03, 0.05, 0.1, and 0.2 (mm). Any of these values can be used as the lower limit of a preferred range (a range from the lower limit to the upper limit) of the first thickness s. Any of the above values that is equal to or larger than the lower limit can be used as the upper limit. For example, a value equal to or larger than 0.03 mm can be used as the first thickness s. A value equal to or less than 0.2 mm can be used as the first thickness s.

The preferred range of the first thickness s can be determined by combining the fourth evaluation test and the sixth evaluation test. For example, a value of 0.03 mm or more and 0.2 mm or less can be used as the first thickness s.

B-7. Seventh Evaluation Test

Figure 7:
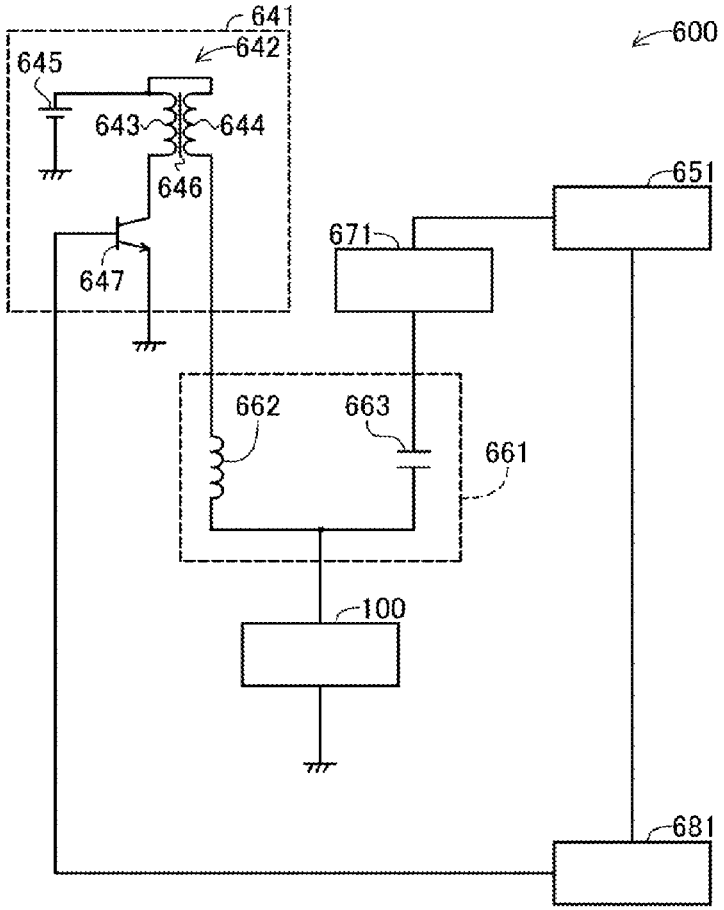
FIG. 7 is a block diagram of an ignition system 600.

FIG. 7 is a block diagram of an ignition system 600 used for a seventh evaluation test. In this ignition system 600, high-frequency power is supplied to the gap of a spark plug to generate high-frequency plasma, and an air-fuel mixture is thereby ignited. The spark plug used in this ignition system 600 is referred to also as a high-frequency plasma plug. The spark plug 100 described in FIGS. 1, 2(A), 2(B), 3(A), and 3(B) can be used as the high-frequency plasma plug. The ignition system 600 will be described on the assumption that the spark plug 100 is connected to the ignition system 600. In this evaluation test, spark plug samples described later were used instead of the spark plug 100.

The ignition system 600 includes the spark plug 100, a discharge power source 641, a high-frequency power source 651, a mixing circuit 661, an impedance matching circuit 671, and a control unit 681. The discharge power source 641 applies a high voltage to the spark plug 100 to generate spark discharge in the gap g of the spark plug 100. The discharge power source 641 includes a battery 645, an ignition coil 642, and an igniter 647. The ignition coil 642 includes a core 646, a primary coil 643 wound around the core 646, and a secondary coil 644 wound around the core 646 and larger in the number of turns than the primary coil 643. One end of the primary coil 643 is connected to the battery 645, and the other end of the primary coil 643 is connected to the igniter 647. One end of the secondary coil 644 is connected to the end of the primary coil 643 that is connected to the battery 645, and the other end of the secondary coil 644 is connected to the metallic terminal 40 of the spark plug 100 through the mixing circuit 661.

The igniter 647 is a so-called switching element and is, for example, an electric circuit including a transistor. The igniter 647 controls, i.e., establishes or breaks, the electrical continuity between the primary coil 643 and a ground in response to a control signal from the control unit 681. When the igniter 647 establishes the electrical continuity, a current flows from the battery 645 to the primary coil 643, and a magnetic field is thereby formed around the core 646. Then, when the igniter 647 breaks the electrical continuity, the current flowing through the primary coil 643 is cut off, and the magnetic field changes. A voltage is thereby generated in the primary coil 643 due to self-induction, and a higher voltage (e.g., 5 kV to 30 kV) is generated in the secondary coil 644 due to mutual induction. This high voltage (i.e., electrical energy) is supplied from the secondary coil 644 to the gap g of the spark plug 100 through the mixing circuit 661, and spark discharge is thereby generated in the gap g.

The high-frequency power source 651 supplies relatively high-frequency electric power (e.g., 50 kHz to 100 MHz, AC power in the present embodiment) to the spark plug 100. The impedance matching circuit 671 is disposed between the high-frequency power source 651 and the mixing circuit 661. The impedance matching circuit 671 is configured such that the output impedance on the high-frequency power source 651 side matches the input impedance on the mixing circuit 661 side.

The mixing circuit 661 supplies both the output power from the discharge power source 641 and the output power from the high-frequency power source 651 to the spark plug 100 while a current is prevented from flowing from one of the discharge power source 641 and the high-frequency power source 651 to the other. The mixing circuit 661 includes a coil 662 connecting the discharge power source 641 to the spark plug 100 and a capacitor 663 connecting the impedance matching circuit 671 to the spark plug 100. The coil 662 allows the relatively low-frequency current from the discharge power source 641 to flow and prevents the relatively high-frequency current from the high-frequency power source 651 from flowing. The capacitor 663 allows the relatively high-frequency current from the high-frequency power source 651 to flow and prevents the relatively low-frequency current from the discharge power source 641 from flowing. The secondary coil 644 may be used instead of the coil 662, and the coil 662 may be omitted.

In the ignition system 600 in FIG. 7, the high-frequency electric power from the high-frequency power source 651 is supplied to the spark generated in the gap g by the electric power from the discharge power source 641, and high-frequency plasma is thereby generated. The control unit 681 controls the timing of supply of the electric power from the discharge power source 641 to the spark plug 100 and the timing of supply of the electric power from the high-frequency power source 651 to the spark plug 100. For example, a computer having a processor and a memory can be used as the control unit 681.

In the seventh evaluation test using a spark plug sample, the consumption volume of the electrode tip 300 of the center electrode 20 (FIG. 2(B)) when electric discharge was repeated using the ignition system 600 in FIG. 7 was evaluated. The second outer layer 310 of the electrode tip 300 of the sample was formed of a material obtained by adding an oxide to a noble metal (the noble metal was a main component). Table 7 below shows the composition of the oxide added, the melting point of the oxide, the consumption volume, and the results of evaluation.

TABLE 7

| OXIDE ADDED | MELTING POINT (° C.) | CONSUMPTION VOLUME ($mm^3$) | JUDGMENT |
|---|---|---|---|
| $Sm_2O_3$ | 2325 | 0.16 | A |
| $La_2O_3$ | 2315 | 0.19 | A |
| $Nd_2O_3$ | 2270 | 0.2 | A |

TABLE 7-continued

| OXIDE ADDED | MELTING POINT (° C.) | CONSUMPTION VOLUME ($mm^3$) | JUDGMENT |
|---|---|---|---|
| $TiO_2$ | 1840 | 0.35 | A |
| $Fe_2O_3$ | 1566 | 0.61 | B |

In the seventh evaluation test, 5 samples different in the composition of the oxide added to the second outer layer 310 were evaluated. Configurational factors of the spark plugs other than the composition of the oxide were common to the five samples. Specifically, the configuration shown in FIG. 2(B) was used as the configuration of the center electrode. The ground electrode used was a member (not shown) obtained by welding an electrode tip to a rod-shaped portion (referred to as a "shaft portion 30") having the same configuration as the ground electrode 30 in FIG. 1. The electrode tip of the ground electrode was fixed to a position spaced apart in the forward direction D1 from the forward end surface 315 of the electrode tip 300 of the center electrode 20, i.e., a position located on the surface of the shaft portion 30 on the rearward direction D2 side and intersecting the axial line CL. The discharge gap was formed between the electrode tip 300 of the center electrode 20 and the electrode tip of the ground electrode. The resistor 70 (FIG. 1) and the second seal portion 80 were omitted. Instead of these, the first seal portion 60 was used to connect the center electrode 20 to the metallic terminal 40 within the through hole 12 (the leg portion 43 of the metallic terminal 40 was extended toward the center electrode 20). The other components of the spark plug sample were the same as those shown in FIG. 1. For example, the following components were common to the five samples.

Material of base member 35 of ground electrode: INCONEL 600

Material of core 36 of ground electrode: Copper

Material of electrode tip of ground electrode: Platinum

Material of outer layer 21 of shaft portion 200: INCONEL 600

Material of core 22 of shaft portion 200: Copper

Material of second outer layer 310 of electrode tip 300: Iridium+oxide

Amount of oxide added to material of second outer layer 310: 7.2% by volume (vol %)

Material of second core 320 of electrode tip 300: Copper

Outer diameter D of electrode tip 300: 1.6 mm

Total length Lt of electrode tip 300: 3.0 mm

First thickness s of tubular portion 313: 0.2 mm

Second thickness t of forward end portion 311: 0.2 mm

Initial value of distance of gap g: 0.8 mm

The evaluation test was performed as follows. A spark plug sample was placed in nitrogen at 0.4 MPa, and electric discharge was repeated at 30 Hz for 10 hours using the ignition system 600 in FIG. 7. The voltage of the battery 645 was 12 V. The frequency of the AC power from the high-frequency power source 651 was 13 MHz. The electric discharge was generated by applying discharge voltage between the metallic terminal 40 and the metallic shell 50. As a result of the repeated electric discharges, the electrode tip 300 was consumed. The consumption volume in Table 7 is the amount of decrease in the volume of the electrode tip 300 due to consumption. The consumption volume was computed as follows. The external shape of the electrode tip 300 before the test and the external shape of the electrode tip 300 after the test were determined by X-ray CT scanning. Then the difference between the volumes of the two determined external shapes was computed as the consumption volume. In Table 7, an A rating indicates that the consumption volume is 0.35 $mm^3$ or less, and a B rating indicates that the consumption volume exceeds 0.35 $mm^3$.

As shown in Table 7, the oxides in the five samples are $Sm_2O_3$, $La_2O_3$, $Nd_2O_3$, $TiO_2$, and $Fe_2O_3$. The melting points of these oxides are 2,325, 2,315, 2,270, 1,840, and 1,566 (° C.), respectively. The higher the melting point of the oxide, the smaller the consumption volume. When the second outer layer 310 of the electrode tip 300 contained any of these oxides, the consumption of the second outer layer 310, i.e., the electrode tip 300, could be restrained. Preferably, the second outer layer 310 of the electrode tip 300 contains at least one of the five oxides shown in Table 7, as described above.

As shown by the melting point and consumption volume in Table 7, the higher the melting point of the oxide, the more the consumption is restrained. The reason for this is presumed to be as follows. The heat generated by electric discharge causes the temperature of the second outer layer 310 to increase. The increase in the temperature of the second outer layer 310 can cause the oxide to fuse. When the oxide fuses, the oxide flows and moves, and this can cause consumption of the noble metal, as in the case in which no oxide is added. When the melting point of the oxide is high, the oxide is less likely to fuse as compared to the case in which the melting point is low. Therefore, the higher the melting point of the oxide, the more the consumption of the second outer layer 310 (i.e., the electrode tip 300) can be restrained.

As shown in Table 7, when the oxide having a melting point of 1,566° C. ($Fe_2O_3$ in this case) was added, the consumption volume was 0.61 $mm^3$. When the oxide having a melting point of 1,840° C. ($TiO_2$ in this case) was added, the consumption volume was 0.35 $mm^3$. By changing the oxide from one of these two oxides to the other having a higher melting point, the consumption volume could be reduced by 40% or more ((0.61−0.35)/0.61=0.426). When the melting point of the oxide was higher than 1,840° C., the consumption volume could be further reduced. As described above, when the second outer layer 310 of the electrode tip 300 contained an oxide having a melting point of 1,840° C. or higher, the consumption of the electrode tip 300 could be significantly restrained. Specifically, it is preferable that the second outer layer 310 contains at least one of $Sm_2O_3$, $La_2O_3$, $Nd_2O_3$, and $TiO_2$.

As shown in Table 7, various oxides could restrain the consumption of the electrode tip 300. It is generally presumed that the consumption of the electrode tip 300 can be restrained even when an oxide other than the oxides evaluated in the seventh evaluation test is used. Particularly, as shown in Table 7, various metal oxides could restrain the consumption of the electrode tip 300. Therefore, it is presumed that not only the metal oxides evaluated in the seventh evaluation test but also other various metal oxides can restrain the consumption of the electrode tip 300. In any case, it is presumed that, when the melting point of the oxide is high, the consumption of the electrode tip 300 can be more restrained as compared to the case in which the melting point of the oxide is low.

An A rating indicating that the consumption volume was 0.35 $mm^3$ or less was obtained when the melting point was 2,325, 2,315, 2,270, and 1,840 (° C.). Any of these four values can be used as the lower limit of a preferred range (a range from the lower limit to the upper limit) of the melting point of the oxide contained in the second outer layer 310 of the electrode tip 300. For example, the preferred range of the melting point of the oxide may be a range of 1,840° C. or higher. Any of the above four values that is equal to or higher than the lower limit can be used as the upper limit. For example, the preferred range of the melting point may be a range of 2,325° C. or lower. It is presumed that, even when the melting point is higher than the above values, the addition of the oxide can restrain the consumption of the electrode tip 300. For example, an oxide having a melting point of 3,000° C. or lower may be used as a practical oxide.

In the electrode tip 300 with the second outer layer 310 containing an oxide, it is preferable that the first thickness s (FIG. 2(A)) is within the above preferred range. With this configuration, it is presumed that the consumption of the second outer layer 310 can be appropriately restrained. In addition, it is preferable that the second thickness t is within the above preferred range. With this configuration, it is presumed that the consumption of the second outer layer 310 can be appropriately restrained. However, at least one of the first thickness s and the second thickness t may be outside its corresponding preferred range.

C. Modifications (1) The material of the core 320 of the electrode tip 300 is not limited to copper, silver, and gold, and various materials having a higher thermal conductivity than the second outer layer 310 can be used. For example, pure nickel can be used. In any case, since the core 320 is formed of a material having a higher thermal conductivity than the second outer layer 310, the increase in temperature (i.e., consumption) of the second outer layer 310 can be restrained. Therefore, it is presumed that, when copper, silver, gold, or any material having a higher thermal conductivity than the second outer layer 310 is used as the material of the core 320, the above-described preferred range of the first thickness s can be applied.

It is presumed that the ease of heat transfer from the electrode tip 300 to the shaft portion 200 or 200*a* varies significantly according to the first thickness s and the ratio of the first thickness s to the outer diameter D. Therefore, it is presumed that the above-described preferred range of the first thickness s can be applied irrespective of configurational factors other than the first thickness s and the ratio of the first thickness s to the outer diameter D. For example, it is presumed that the above-described preferred range of the first thickness s can be applied even in the case where at least one of the outer diameter D, the total length Lt, the material of the second outer layer 310, the material of the core 320, and the second thickness t differs from that of the above-described samples of the electrode tip 300.

(2) It is presumed that the temperature of the core 320 of the electrode tip 300 when the core 320 receives heat from the second outer layer 310 varies significantly according to the distance between the forward end surface 321 of the core 320 and the discharge surface 315 of the second outer layer 310, i.e., the second thickness t. Therefore, it is presumed that the above-described preferred range of the second thickness t can be applied irrespective of configurational factors other than the second thickness t. For example, it is presumed that the above-described preferred range of the second thickness t can be applied even in the case where at least one of the outer diameter D, the total length Lt, the material of the second outer layer 310, the material of the core 320, and the first thickness s differs from that of the above-described samples of the electrode tip 300.

(3) As described above, the consumption of the electrode tip 300 is largely influenced by the first thickness s, the ratio of the first thickness s to the outer diameter D, and the second thickness t. Therefore, it is presumed that the above-described preferred range of the outer diameter D can be applied irrespective of configuration factors other than the first thickness s, the ratio of the first thickness s to the outer diameter D, and the second thickness t. For example, it is presumed that the above-described preferred range of the outer diameter D can be applied even in the case where at least one of the total length Lt, the material of the second outer layer 310, and the material of the core 320 differs from that of the above-described samples of the electrode tip 300. Particularly, it is presumed that, when the first thickness s, the ratio of the first thickness s to the outer diameter D, and the second thickness t are within the above-described preferred ranges, the above-described preferred range of the outer diameter D can be appropriately applied.

(4) The shape of the core 320 of the electrode tip 300 is not limited to a substantially cylindrical shape with its center on the center axis CL, and various shapes can be used. For example, in the above embodiments, the forward end surface 321 of the core 320 is a flat surface perpendicular to the center axis CL, but the forward end surface of the core 320 may be a curved surface. In any case, a surface portion of the core 320 that can be seen when the core 320 is observed in the rearward direction D2 from the forward direction D1 side of the core 320 can be used as the forward end surface of the core 320. The portion of the core 320 that forms the forward end surface can be used as a forward end portion. As the axial thickness t of the forward end portion of the second outer layer 310 that covers the forward end portion of the core 320, the minimum of the distance between the forward end surface of the core 320 and the outer surface of the forward end portion of the second outer layer 310 in the direction parallel to the center axis CL can be used.

As the radial thickness s of a portion of the second outer layer 310 that covers the outer circumferential surface of the core 320, the thickness of a circle with its center on the center axis of the substantially cylindrical electrode tip 300 (in the above embodiments, this center axis is the same as the center axis CL of the spark plug 100) can be used. As the outer circumferential surface of the core 320, a surface portion of the core 320 other than the above-described forward end surface and the rear end surface described later can be used. As the rear end surface of the core 320, a surface portion of the core 320 that can be seen when the core 320 is observed in the forward direction D1 from the rearward direction D2 side of the core 320 can be used. In the example in FIG. 2(B), the boundary portion between the core 320 and the fused joint portion 230 corresponds to the rear end surface of the core 320. The radial thickness of a portion of the second outer layer 310 that covers the outer circumferential surface of the core 320 may vary depending on the position on the outer circumferential surface. In this case, the minimum of the varying thickness can be used as the first thickness s.

(5) The material of the second outer layer 310 of the electrode tip 300 is not limited to platinum (Pt), and a material containing any of various noble metals can be used. Each of platinum (Pt), iridium (Ir), rhodium (Rh), ruthenium (Ru), palladium (Pd), and gold (Au) has high corrosion resistance. Therefore, when a material containing any one of these noble metals as a main component is used, the consumption of the second outer layer 310 can be appropriately restrained. Not only a material containing a specific element and another element but also a material containing only the specific element can be referred to as a material containing the specific element as a main component.

A material containing as a main component an alloy of a noble metal and copper may be used as the material of the second outer layer 310. For example, a material containing as a main component an alloy of copper and any one of the above-described six noble metals (Pt, Ir, Rh, Ru, Pd, and Au) may be used. It is presumed that, even when such a material is used, the consumption of the second outer layer 310 can be restrained appropriately. The second outer layer 310 formed of a material containing a noble metal as a main component or a material containing as a main component an alloy of a noble metal and copper may further contain an oxide having a melting point of 1,840° C. or higher. In this case, it is presumed that the consumption of the second outer layer 310 can be further restrained. However, the oxide may be omitted.

(6) The material of the outer layer 21, 21*a* of the shaft portion 200, 200*a* is not limited to a material containing Ni, and various materials having higher corrosion resistance than the core 22 can be used. For example, stainless steel may be used.

(7) The configuration of the spark plug is not limited to the configuration described in FIG. 1, and various configurations can be used. For example, a noble metal tip may be provided in a portion of the ground electrode 30 that forms the gap g. As the material of the noble metal tip, various materials containing noble metals that are the same as the materials for the second outer layer 310 of the electrode tip 300 can be used.

Figure 8B:
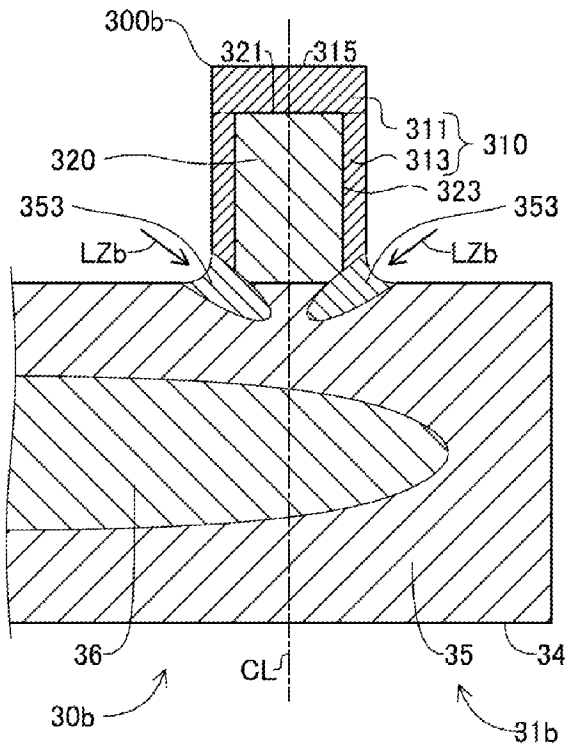
FIGS. 8(A) and 8(B) are schematic illustrations showing an embodiment of a ground electrode having an electrode tip.
Figure 8A:
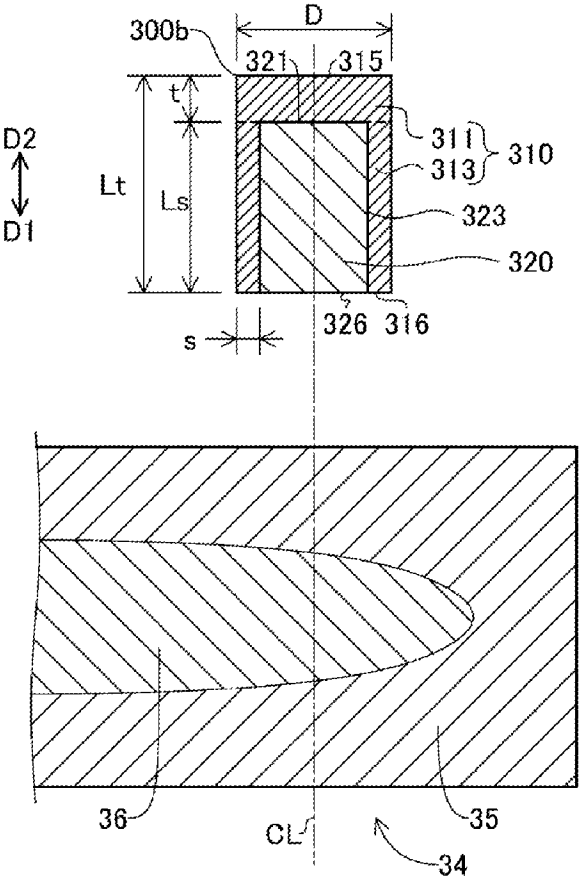

An electrode tip having the same configuration as the electrode tip 300 may be provided in a portion of the ground electrode that forms the gap g. FIGS. 8(A) and 8(B) are schematic illustrations showing an embodiment of the ground electrode having the electrode tip. The figure shows cross sections of a forward end portion 31*b* of the ground electrode 30*b* having the electrode tip 300*b*. The ground electrode 30*b* has the electrode tip 300*b* having the same configuration as the electrode tip 300 in FIGS. 2(A), 2(B) and a rod-shaped portion 34 (referred to as a "shaft portion 34") having the same configuration as the ground electrode 30 in FIG. 1. Components of the ground electrode 30*b* that are the same as the components shown in FIGS. 1, 2(A), and 2(B) are denoted by the same symbols, and the description thereof will be omitted. The left side of the figure shows the shaft portion 34 and the electrode tip 300*b* before they are joined to each other. The right side of the figure shows the shaft portion 34 and the electrode tip 300*b* joined to each other. Each of these cross sections contains the center axis CL.

Arrows LZb FIG. 8(B) schematically represent laser light used for joining (laser welding in this case). The entire circumference of the boundary (not shown) between the shaft portion 34 and the electrode tip 300*b* disposed on the surface of the shaft portion 34 is irradiated with the laser light LZb. As a result of the irradiation with the laser light LZb, a fused joint portion 353 that joins the shaft portion 34 to the electrode tip 300*b* is formed. The fused joint portion 353 is a portion fused during welding. In the embodiment in FIG. 8(B), the fused joint portion 353 is in contact with the base member 35 of the shaft portion 34, the second outer layer 310 of the electrode tip 300*b*, and the core 320 of the electrode tip 300*b*. The fused joint portion 353 joins the base member 35 of the shaft portion 34 to the second outer layer 310 and core 320 of the electrode tip 300*b*.

The use of the ground electrode 30*b* described above allows heat to be released from the second outer layer 310 through the core 320 to the shaft portion 34. Therefore, an increase in the temperature of the second outer layer 310 can be restrained. The consumption of the second outer layer 310 can thereby be restrained. The fused joint portion 353 may be spaced apart from the core 320 of the electrode tip 300*b*. Even in this case, heat can be released from the second outer layer 310 through the core 320 to the shaft portion 34, so that the consumption of the second outer layer 310 can be restrained. For example, the fused joint portion 353 may join the second outer layer 310 to the base member 35 of the shaft portion 34. The electrode tip of the center electrode and the electrode tip of the ground electrode may have different configurational factors (e.g., material, dimensions, shape, etc.). When the ground electrode 30*b* is used, the electrode tip 300*z* in FIGS. 4(A), 4(B) may be used as the electrode tip of the center electrode, or a center electrode having no noble metal tip may be used.

As the configurational factors (e.g., material, dimensions, shape, etc.) of the ground electrode 30*b*, the same configurational factors as those described as the configurational factors of the center electrode 20 or 20*a* can be used. For example, it is preferable to use a material having higher corrosion resistance than the core 36 of the shaft portion 34 (e.g., nickel or an alloy containing nickel as a main component) as the material of the base member 35 (corresponding to the outer layer) that covers at least part of the core 36. It is preferable to use a material having a higher thermal conductivity than the base member 35, such as a material containing copper (e.g., pure copper or an alloy containing copper), as the material of the core 36 of the shaft portion 34.

Various materials containing noble metals can be used as the material of the second outer layer 310 of the electrode tip 300*b*. For example, it is preferable to use a material containing as a main component any one of platinum, iridium, rhodium, ruthenium, palladium, and gold. It is preferable to use a material having a higher thermal conductivity than the second outer layer 310 of the electrode tip 300*b* as the material of the core 320 of the electrode tip 300*b*. For example, it is preferable to use a material containing at least one of copper, silver, and pure nickel.

A material containing as a main component an alloy of a noble metal and copper may be used as the material of the second outer layer 310 of the electrode tip 300*b*. For example, a material containing as a main component an alloy of copper and any one of the above-described six noble metals (Pt, Ir, Rh, Ru, Pd, and Au) may be used. It is presumed that, even when such a material is used, the consumption of the second outer layer 310 can be restrained appropriately. The second outer layer 310 formed of a material containing a noble metal as a main component or a material containing as a main component an alloy of a noble metal and copper may further contain an oxide having a melting point of 1,840° C. or higher. In this case, it is presumed that the consumption of the second outer layer 310 of the electrode tip 300*b* can be further restrained. However, the oxide may be omitted.

The core 36 may be exposed at a surface of the shaft portion 34, i.e., its surface joined to the electrode tip 300*b*, and the core 320 of the electrode tip 300*b* may be joined directly to the core 36 of the shaft portion 34. With this configuration, an increase in the temperature of the second outer layer 310 can be appropriately restrained through the core 320 and the core 36. In addition, the core 36 of the shaft portion 34 and the core 320 of the electrode tip 300*b* may be formed of the same material. With this configuration, the core 36 and the core 320 can be joined easily to each other.

As preferred ranges of the parameters D, Lt, s, and t of the electrode tip 300*b* of the ground electrode 30*b*, the above-described preferred ranges of the parameters D, Lt, s, and t of the electrode tip 300 of the center electrode 20 or 20*a* can be used. It is presumed that the use of the above-described preferred ranges can restrain the consumption of the electrode tip 300*b* of the ground electrode 30*b*.

(8) As described above, the shaft portion having the first core and the first outer layer (referred to also as a "shaft portion with a core") and the electrode tip having the second core and the second outer layer (referred to also as a "tip with a core") can be applied to at least one of the center electrode and the ground electrode. A center electrode having the shaft portion with the core and the tip with the core (e.g., the center electrodes 20 and 20*a* in FIGS. 2(B) and 3(B)) can be applied to various spark plugs. A ground electrode having the shaft portion with the core and the tip with the core (e.g., the ground electrode 30*b* in FIG. 8(B)) can be applied to various spark plugs. For example, a spark plug may be used, in which an air-fuel mixture in a combustion chamber of an internal combustion engine is ignited directly by a spark generated in a gap formed between the center electrode and the ground electrode (e.g., the gap g in FIG. 1). A spark plug described in FIG. 7 may be used, in which an air-fuel mixture is ignited using a spark and high-frequency plasma generated in the gap. A plasma jet plug may also be used, in which the gap between the center electrode and the ground electrode is disposed in a space formed by an insulator. In this plasma jet plug, a spark generated in the gap is used to generate plasma in the space, and the generated plasma is injected from the space into a combustion chamber to ignite an air-fuel mixture.

Although the present invention has been described on the basis of the embodiments and modifications, the above-described embodiments of the present invention are provided for facilitating an understanding of the present invention and do not limit the present invention. The present invention may be modified and improved without departing from the scope and claims of the present invention and encompasses equivalents thereof.

INDUSTRIAL APPLICABILITY

The present disclosure can be preferably used for spark plugs used for internal combustion engines etc.

DESCRIPTION OF REFERENCE NUMERALS

5: gasket
6: first rear-end-side packing
7: second rear-end-side packing
8: forward-end-side packing
9: talc
10: ceramic insulator (insulator)
11: second outer-diameter decreasing portion
12: through hole (axial hole)
13: leg portion
15: first outer-diameter decreasing portion
16: inner-diameter decreasing portion
17: forward-end-side trunk portion
18: rear-end-side trunk portion
19: flange portion
20, 20*a*, 20*z*: center electrode
20*s*1: forward end surface (surface)
21, 21*a*: first outer layer
22, 22*a*: first core
23: head portion
24: flange portion
25: leg portion
30, 30*b*: ground electrode
31: forward end portion
35: base member

36: core
40: metallic terminal
41: cap attachment portion
42: flange portion
43: leg portion
50: metallic shell
51: tool engagement portion
52: threaded portion
53: crimp portion
54: seat portion
55: trunk portion
56: inner-diameter decreasing portion
58: deformable portion
59: through hole
60: first seal portion
70: resistor
80: second seal portion
100: spark plug
200, 200*a*: shaft portion
211, 211*a*: forward end surface
220: diameter decreasing portion
230, 230*a*, 230*z*: fused joint portion
240: joint portion
300, 300*b*, 300*z*: electrode tip
306*z*: rear end surface
310: second outer layer (noble metal layer)
311: forward end portion
313: tubular portion
315: surface (discharge surface)
316: rear end surface
320: second core
321: forward end surface
323: outer circumferential surface
326: rear end surface
641: discharge power source
642: ignition coil
643: primary coil
644: secondary coil
645: battery
646: core
647: igniter
651: high-frequency power source
661: mixing circuit
662: coil
663: capacitor
671: impedance matching circuit
681: control unit
CL: center axis (axial line)
D1: forward direction
D2: rearward direction
SP: space
g: gap Having described the invention, the following is claimed:

1. A spark plug, comprising:

a center electrode; and a ground electrode that forms a gap with the center electrode, wherein at least one of the center electrode and the ground electrode includes a shaft portion, an electrode tip, and a fused joint portion through which the electrode tip is welded to one surface of the shaft portion, wherein the shaft portion includes a first core formed of a material containing copper and a first outer layer that is formed of a material having higher corrosion resistance than the first core, the first outer layer covering at least part of the first core, wherein the electrode tip has a substantially cylindrical shape and includes a second outer layer that is formed of a material containing a noble metal and a second core that is formed of a material having a higher thermal conductivity than the second outer layer, the second outer layer forming an outer surface of the electrode tip and covering at least a forward end surface and an outer circumferential surface of the second core, wherein the second outer layer is welded to the first outer layer through the fused joint portion, and wherein the first core and the second core are joined by a diffusion bond joint portion.

2. A spark plug according to claim 1, wherein the second outer layer is formed of a main component material selected from the group consisting of at least one of six noble metals including platinum, iridium, rhodium, ruthenium, palladium, and gold or an alloy of copper and at least one of the six noble metals.

3. A spark plug according to claim 2, wherein the second outer layer contains an oxide having a melting point of 1,840° C. or higher.

4. A spark plug according to claim 1, wherein the first core and the second core are joined directly to each other.

5. A spark plug according to claim 4, wherein the first core and the second core are formed of an identical material.

6. A spark plug according to claim 1, wherein the shaft portion of the center electrode extends in an axial direction, wherein the electrode tip is joined to a forward end of the shaft portion, and a thickness s is 0.03 mm or more and equal to or less than one-third of an outer diameter D, where the outer diameter D is an outer diameter of the electrode tip, and the thickness s is a radial thickness of a portion of the second outer layer that covers an outer circumferential surface of the second core.

7. A spark plug according to claim 6, wherein an axial thickness t of a forward end portion of the second outer layer that covers a forward end portion of the second core is 0.1 mm or more and 0.4 mm or less.

8. A spark plug according to claim 6, wherein the shaft portion and the electrode tip are laser welded to each other, and wherein at least part of an axial range of a joint portion between the first core and the second core overlaps an axial range of the fused joint portion.

9. A spark plug according to claim 1, wherein the fused joint portion is a laser welded joint portion.

* * * * *